US012339014B2

(12) United States Patent
Gelardi et al.

(10) Patent No.: US 12,339,014 B2
(45) Date of Patent: Jun. 24, 2025

(54) AUTOMATED TEMPERATURE CONTROL OF HEATING RADIATORS

(71) Applicant: Therm Controls Incorporated, New York, NY (US)

(72) Inventors: Pepin Gelardi, Brooklyn, NY (US); Joseph Gonzalez, Brooklyn, NY (US); Jingwen Zhu, Brooklyn, NY (US); Jackson Zhao, Brooklyn, NY (US); Jesse Klein, Brooklyn, NY (US); Andrew Staniforth, New York, NY (US)

(73) Assignee: Therm Controls Incorporated, New York, NY (US)

( * ) Notice: Subject to any disclaimer, the term of this patent is extended or adjusted under 35 U.S.C. 154(b) by 1225 days.

(21) Appl. No.: 17/019,607

(22) Filed: Sep. 14, 2020

(65) Prior Publication Data

US 2020/0408422 A1 Dec. 31, 2020

Related U.S. Application Data

(63) Continuation-in-part of application No. 15/660,891, filed on Jul. 26, 2017, now Pat. No. 10,816,223.

(60) Provisional application No. 62/910,154, filed on Oct. 3, 2019.

(51) Int. Cl.

| | |
|---|---|
| ***F24D 19/10*** | (2006.01) |
| ***F24D 1/02*** | (2006.01) |
| ***F24D 19/08*** | (2006.01) |

(52) U.S. Cl.

CPC ..... *F24D 19/1003* (2013.01); *F24D 1/02* (2013.01); *F24D 19/08* (2013.01); *F24D 2220/2027* (2013.01); *F24D 2240/00* (2013.01)

(58) Field of Classification Search

None

See application file for complete search history.

(56) References Cited

U.S. PATENT DOCUMENTS

| | | | | |
|---|---|---|---|---|
| 1,490,940 | A | 4/1924 | Russell | |
| 2,338,495 | A | 1/1944 | Davies | |
| 2,368,712 | A | 2/1945 | Jehle et al. | |
| 3,963,177 | A | 6/1976 | Frank | |
| 4,147,302 | A | 4/1979 | Gray | |
| 4,158,398 | A * | 6/1979 | Riddel | B60K 31/00 91/453 |
| 4,750,546 | A | 6/1988 | Godbout et al. | |
| 4,765,537 | A | 8/1988 | Donovan | |

(Continued)

*Primary Examiner* — Edelmira Bosques
*Assistant Examiner* — Deepak A Deean
(74) *Attorney, Agent, or Firm* — Myers Wolin, LLC

(57) ABSTRACT

Embodiments are disclosed of a radiator temperature control apparatus for controlling the heat output of a radiator. The radiator temperature control apparatus may include an airtight enclosure around the air outlet of the radiator air vent, an adjustable opening in the airtight enclosure controlled by an actuator, and a controller connected to the actuator. In operation, the controller can be configured to open the adjustable opening in the airtight enclosure allowing air in the radiator to be expelled through the adjustable opening, thereby allowing steam to enter the radiator, and heat the room. The controller can be configured to close the adjustable opening, stopping air from being expelled from the radiator, thereby stopping additional steam from entering the radiator.

18 Claims, 20 Drawing Sheets

(56) References Cited

U.S. PATENT DOCUMENTS

| | | | | |
|---|---|---|---|---|
| 5,735,456 | A * | 4/1998 | Marin | F16K 31/046 236/75 |
| 7,957,839 | B2 | 6/2011 | Takach et al. | |
| 9,046,896 | B1 * | 6/2015 | Brunelle | F24D 19/1003 |
| 9,418,802 | B2 | 8/2016 | Romano et al. | |
| 10,006,642 | B2 | 6/2018 | Gluck | |
| 10,041,689 | B2 | 8/2018 | Kymissis et al. | |
| 2005/0016592 | A1 * | 1/2005 | Jeromson | G05D 16/202 137/487.5 |
| 2010/0045470 | A1 * | 2/2010 | Araiza | F24D 1/02 700/282 |
| 2011/0048685 | A1 * | 3/2011 | Cardno | F24D 19/0075 251/148 |
| 2011/0127343 | A1 | 6/2011 | Rimmer | |
| 2014/0252101 | A1 | 9/2014 | Kiouzellis | |
| 2015/0167996 | A1 | 6/2015 | Fadell et al. | |
| 2015/0323200 | A1 * | 11/2015 | Gluck | F24H 15/36 237/9 R |
| 2016/0290737 | A1 | 10/2016 | Cox et al. | |
| 2018/0180302 | A1 | 6/2018 | Gabriel et al. | |
| 2018/0181150 | A1 * | 6/2018 | Zuluaga | F24D 19/1003 |

* cited by examiner

AUTOMATED TEMPERATURE CONTROL OF HEATING RADIATORS

CROSS-REFERENCE TO RELATED APPLICATIONS

This application is a continuation in part of U.S. patent application Ser. No. 15/660,891, filed Jul. 26, 2017, and claims the benefit of U.S. Provisional Application No. 62/910,154, filed Oct. 3, 2019, the contents of each of which are incorporated by reference herein.

This invention was made with the support of the New York State Energy Research and Development Authority (NYSERDA) under Agreement Number 133273 and NYSERDA may have rights in this invention.

FIELD OF THE INVENTION

This disclosure relates to systems and methods for automation, monitoring, and control of pre-existing heating systems, namely steam heating systems.

BACKGROUND

The present invention relates to the automation, monitoring, and control of pre-existing heating systems. As is known in the art, control systems for Heating, Ventilation, and Air Conditioning (HVAC) systems have been evolving—from simple mechanical thermostats to wirelessly controlled "smart" devices. This evolution has allowed for home owners, landlords, and tenants to have greater control of their energy usage and better customize and control the comfort of their spaces.

These new "smart" devices typically replace an older iteration of a similar product (ex. a "smart" thermostat replaces a mechanical thermostat). These new devices are also typically hard wired or plumbed into existing HVAC systems, and in many cases, require advanced skill (ex. trained electrician/licensed plumber) to install the technology properly.

Modern central heating systems, in general, typically fall into three categories: forced hot air, hot water, and steam. Typically, forced hot air systems rely on a central furnace and a system of ducts to heat and deliver the warmed air. Typically, hot water systems rely on a central boiler and a system of pipes and radiators and/or convectors to deliver hot water; that hot water emits heat warming the space. Typically, steam systems also rely on a central boiler and a system of pipes and radiators and/or convectors to deliver steam; that steam emits heat warming the space.

Steam systems have two typical configurations: two pipe, and one pipe.

In a two-pipe system, steam is delivered to the radiators through pipes. Each radiator has two pipes connected to it. One pipe delivers the hot steam from the boiler. As the heat in the steam is transferred to the room, the water vapor condenses. That condensed water flows through the second pipe connected to the radiator and flows back to the boiler.

In a one-pipe system, steam is delivered to the radiators through pipes. Each radiator has only one pipe connected to it. As the heat in the steam is transferred to the room, the water vapor condenses. That condensed water flows through the same pipe system back to the boiler.

Air is present within a one-pipe steam system. As steam is created in the boiler and flows to the radiators, the air in the system is pushed out through a series of vents. The vents are calibrated to allow the release of air, but trap the steam within the radiator. These vents allow the expulsion of the air in the system, which is required to allow the steam to flow and fill the radiator.

The vents are located on each radiator and also on locations throughout the main pipe system. If the vent is forced closed or blocked, the steam will not flow, and the radiator will not heat the room.

One pipe steam systems are typically controlled by one thermostat or a series of thermostats (central thermostat control). In some configurations when a series of thermostats is used in different rooms and/or on different floors, the thermostats may deliver the average temperature of the building to the boiler control. The thermostat(s) control the production of steam in the boiler. When steam is produced in the boiler, it flows freely through the pipe system to the radiators.

Over- and under-heating is common in one pipe steam systems. The thermostat delivers only one area's temperature to the boiler, which becomes the only area influencing the activation of the boiler and the flow of steam. Multiple factors throughout a building, such as doors and windows or occupants and use, cause the temperature in a building vary greatly from one room/floor to another, making a singular thermostat or a series of thermostats imprecise at controlling the heating of a building.

For example, a room with many energy inefficient windows which also contains the one thermostat for the building may activate the boiler more frequently because the inefficient windows cause the temperature in the space to be lower. In the same building, a second room, with energy efficient windows, will have its radiator release heat based on the frequent activation of the thermostat in the first room, causing overheating.

Proper balancing of a system may mitigate some of the temperature disparities throughout the building. This balancing calibrates the system taking into account the differences among rooms/floors to deliver steam heat in a more balanced way. While this may address some of the inefficiencies in the distribution of the heat, the environmental factors within a building often change (such as an open window). Each change would require a new balancing exercise. Additionally, steam systems are extremely prevalent in large pre-war multifamily buildings. The balancing of these buildings can be easily disrupted by one tenant opening a window, or another tenant using the oven, rendering the system balancing ineffective.

Multifamily landlords are typically required by law to deliver a minimum level of heating to their tenants. In order to deliver the minimum level of heating to all tenants, the landlord will often deliver an excess of heat to the overall system in order to meet the minimum level of heating in the coldest unit (ex. a unit on the bottom floor with many inefficient windows and a drafty front door). This causes an overheating of the other units because the system is calibrated to deliver heat based on the coldest unit. Many tenants in the overheated units will open windows to regulate the temperature of their units causing a significant waste of the heat.

Control devices which provide localized control of each radiator exist. Specifically, these devices are Thermostatic Radiator Valves (TRV). These TRVs use room temperature to actuate the radiator vent. The actuation of the vent allows for control of the release of air, thus limiting the flow of steam and thus controlling the heat of the room. These TRVs require the replacement of the existing radiator vent. Modifying a radiator may be intimidating to the average home owner or tenant, and further many tenants would be prohibited from making these modifications to a rental unit.

Therefore, a need exists for a control system and mechanism which allows for control of individual radiators without modification or replacement to components of the existing heating system. There is a further need for such a system that can be easily applied to a variety of radiator types and brands.

SUMMARY

The present invention relates to an apparatus that allows users to remotely or programmatically control heating radiators. The apparatus comprises an airtight enclosure around the air outlet of a radiator air vent, an adjustable opening in said airtight enclosure, an actuator configured to open and close said adjustable opening, and a controller coupled to the actuator.

The apparatus encloses the radiator air vent such that the air outlet of the radiator air vent is sealed within the airtight enclosure of the apparatus. The controller controls the actuator coupled to the adjustable opening in the airtight enclosure. The adjustable opening regulates the flow of air out the airtight enclosure. For the radiator to fill with steam and heat a space, the existing air within the radiator must be expelled through the radiator air vent. The present invention fully encloses the air outlet of the radiator air vent and thus controls the air being expelled from the radiator. To allow steam to enter the radiator and heat the room, the controller, using the actuator, opens the adjustable opening. To stop steam from entering the radiator, the controller, using the actuator, closes the adjustable opening.

In some embodiments, a radiator temperature control apparatus is provided comprising a first housing for enclosing at least a portion of a radiator air vent and a second housing independent of the first housing.

The first housing has a sealing mechanism for forming a seal about an air outlet of the radiator air vent, an internal chamber formed within the first housing and sealed at least partially by the sealing mechanism, and a fluid outlet in a wall of the internal chamber.

The second housing has a fluid inlet, a fluid outlet, and a fluid path between the fluid inlet and the fluid outlet. The second housing also has an adjustable blockage for preventing fluid entering the second housing at the fluid inlet from exiting the second housing at the fluid outlet and an actuator for opening and closing the blockage;

When applied to a radiator air vent, the first housing encloses at least a portion of the radiator air vent, and the second housing is fixed to the first housing such that the fluid outlet of the first housing is in fluid communication with the fluid inlet of the second housing.

In some embodiments, the sealing mechanism of the first housing is a gasket for sealing against the radiator air vent and forming the internal chamber. The first housing may then further comprise a retainer for compressing the radiator air vent against the gasket to form a seal. The retainer in such an embodiment may be a plunger, and a portion of the radiator air vent may then be sandwiched between the plunger and the gasket.

Where the first housing is configured to house a bullet or cylindrical shaped vent, the first housing may be substantially cylindrical and have a side opening for accommodating an inlet of the radiator air vent.

In some embodiments, the blockage of the second housing may be an obstruction in the fluid path which may be closable by the actuator. In some embodiments, the second housing may further comprise a fluid chamber, and the fluid inlet deposits fluid into the fluid chamber. The blockage may then be a membrane for sealing a terminal end of the fluid inlet, and the actuator may then comprise a shaft for applying a force to seal the membrane against the terminal end.

In some embodiments, the radiator temperature control apparatus may comprise a pressure sensor for detecting pressure within the fluid path. For example, the pressure sensor may detect pressure in the fluid path between the fluid inlet and the blockage. Such a pressure sensor may be in the fluid path, or it may be located outside the fluid path and may detect pressure in the fluid path by way of a pressure probe.

In some embodiments, the radiator temperature control apparatus may further comprise a controller for controlling the actuator, where the controller receives pressure information from the pressure sensor and ambient temperature information from a space to be heated by the radiator. The controller may then cause the actuator to open the blockage if the ambient temperature is below a set temperature threshold and the pressure information indicates a pressure above a threshold pressure within the fluid path.

In some embodiments, the second housing further comprises a microphone or an air flow sensor for detecting air flow in the fluid path. Such detection may be for air flow between the blockage and the fluid outlet. In such an embodiment, a controller may receive air flow information from the microphone or air flow sensor and ambient temperature information from a space to be heated by the radiator. The controller may then cause the actuator to close the blockage if the ambient temperature is above a set temperature threshold and the air flow information indicates air flow within the fluid path.

In some embodiments, when the actuator applies an actuation pressure to close the blockage, it is limited to a limiting pressure. The limiting pressure is greater than the actuation pressure. In order to implement such a limiting pressure, the actuator may comprise a bracing element and an actuation tip, and the actuation tip may be moved relative to the bracing element to apply the actuation pressure to close the blockage.

In some embodiments, the actuator may have a spring for locating the bracing element, the spring having a spring force substantially equal to the limiting pressure. The actuation pressure is then applied by increasing a distance between the bracing element and the actuation tip, and the bracing element is fixed relative to the blockage by the spring at pressures below the limiting pressure. The bracing element moves against the spring at pressures above the limiting pressure.

In some embodiments, the actuation tip is moved relative to the bracing element by way of a leadscrew. The bracing element may then comprise a motor for rotating the leadscrew.

In some embodiments, the actuator may comprise an actuator housing having a first end, an actuation end, and an actuation tip adjacent the actuation end, and a bracing element adjacent the first end. The bracing element is then spaced apart from the first end by a spring, and actuation pressure is applied by the actuation tip relative to the bracing element.

In some embodiments, once applied to a radiator vent, the first housing does not move during use and the actuator of the second housing controls fluid flow through the fluid outlet of the first housing.

In some embodiments, the second housing further comprises a controller for instructing the actuator to open or close the blockage and a wireless communications interface for communications between the controller and at least one of a remote server, a remote user interface, and one or more temperature sensors, disposed outside of the second housing and configured to record ambient temperature data and transmit such data to the controller.

In some embodiments, a system is provided for controlling a radiator, the system having an interchangeable first housing for enclosing at least a portion of a radiator air vent and a second housing independent of the first housing.

The second housing has a fluid inlet, a fluid outlet, and a fluid path between the fluid inlet and the fluid outlet. The second housing further comprises a blockage for preventing fluid entering the second housing at the fluid inlet from exiting the second housing at the fluid outlet and an actuator for opening and closing the blockage.

The interchangeable first housing is one of several potential first housings and is selected to conform to a particular radiator air vent. When applied to a radiator air vent, the first housing encloses at least a portion of the air vent, and the second housing is fixed to the first housing such that a fluid outlet of the first housing is in fluid communication with the fluid inlet of the second housing.

In some embodiments, once applied to a radiator vent, the first housing does not move during use, and the actuator in the second housing controls fluid flow through the first housing.

DETAILED DESCRIPTION OF THE PREFERRED EMBODIMENTS

Figure 1:
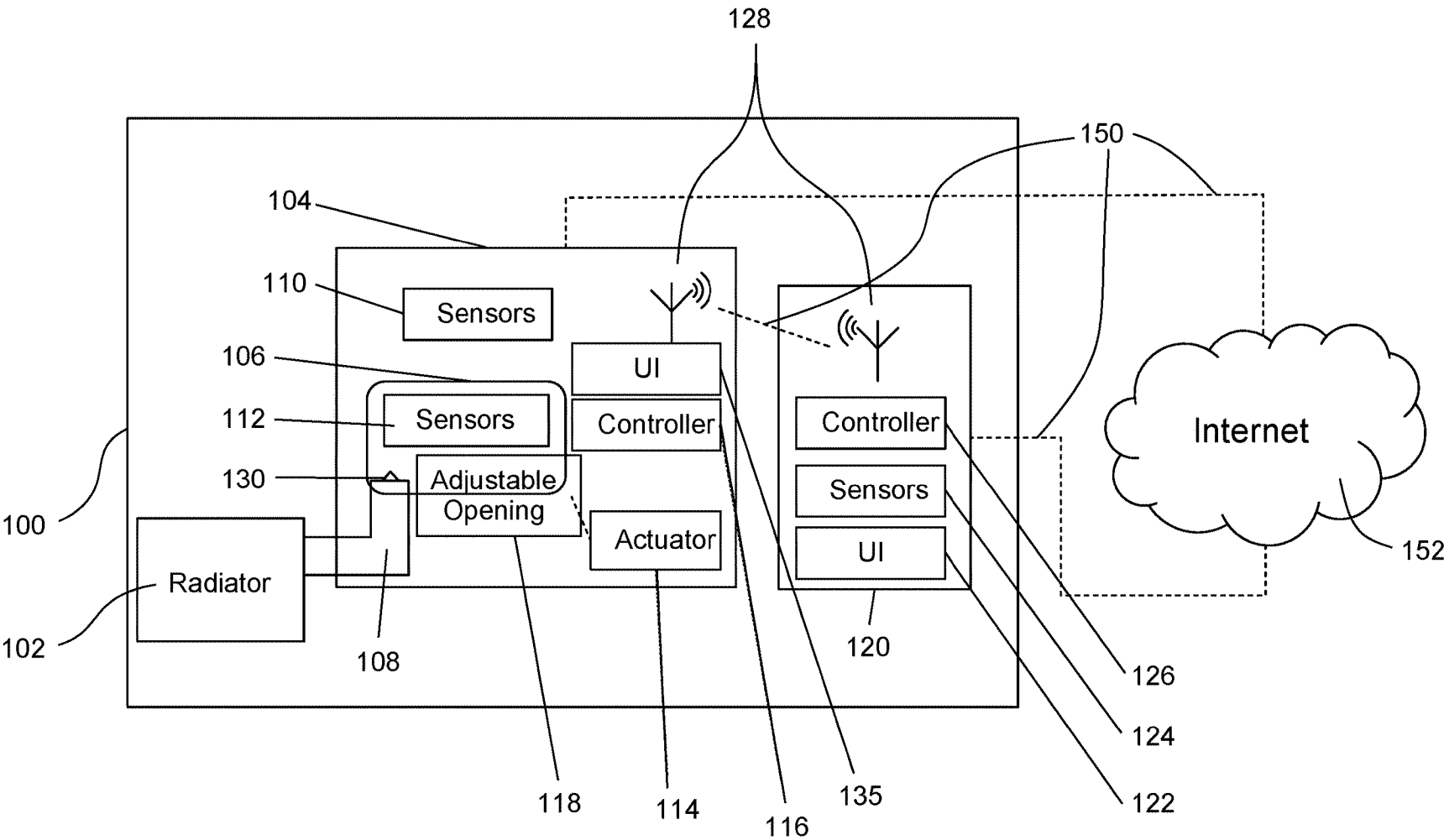
FIG. 1 is a schematic depiction of an embodiment of a radiator temperature control apparatus.

The description of illustrative embodiments according to principles of several illustrative embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits are illustrated by reference to certain exemplified embodiments and may not apply to all embodiments. Accordingly, the invention expressly should not be limited to such exemplary embodiments illustrating some possible non-limiting combination of features that may exist alone or in other combinations of features; the scope of the claimed invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Various embodiments are disclosed herein of novel apparatus and methods for controlling the heat output of a radiator. Some but not all embodiments are disclosed in the text of this section and the accompanying drawings. The following description and drawings are illustrative of the present invention and should not be viewed as limiting the scope of the present invention. Various additional embodiments not described herein may include different configurations, materials, and/or combinations of the described embodiments and fall within the scope of the present invention. These embodiments are provided so that this disclosure will satisfy legal requirements.

The present invention is an apparatus which allows for the remote and/or programmatic regulation of the flow of air out of an air outlet of a radiator air vent, thus regulating the flow of steam into a radiator, and therefore controlling the heating of a room. The apparatus encloses the air outlet of a radiator air vent and does not replace the radiator air vent, thus eliminating the need for modifications to the heating system.

FIG. 1 is a diagrammatic example of a radiator temperature control apparatus 104 used to control the heat in room 100 emitted from a radiator 102. In embodiments, a one-pipe steam radiator 102 has an air vent 108, and the air vent has an air outlet 130. In embodiments, the radiator temperature control apparatus 104 contains an airtight enclosure 106 around the air outlet 130 the air vent 108, an actuator 114, a controller 116, and an adjustable opening 118. The actuator 114 may be coupled to the adjustable opening 118. The controller 116 may be coupled to the actuator 114.

In embodiments, an actuator 114 within the radiator temperature control apparatus 104 is provided. The actuator 114 controls the adjustable opening 118 regulating the release of air within the airtight enclosure 106. In embodiments, the adjustable opening 118 maintains the airtight seal of the airtight enclosure 106 around the air outlet 130 when closed, and when open, the airtight seal of the airtight enclosure 106 is broken and the air within the airtight enclosure 106 can escape through the adjustable opening 118.

In embodiments, the radiator temperature control apparatus includes a controller 116 to handle the logic required to control the actuator 114. Additionally, the controller may handle scheduling and to run calculations and/or algorithms used to better customize and control the regulation of heat within the room.

In some embodiments, the airtight enclosure 106 may enclose part or all of the radiator air vent 108. In some embodiments, the airtight enclosure 106 may enclose only the air outlet 130. In some embodiments, the airtight enclosure 106 is created using closed cell foam to provide an airtight seal around the air outlet 130 and/or air vent 108. In some embodiments, an elastic sleeve is rolled over the air vent 108 to create the airtight enclosure 106 around the air outlet 130.

For radiator 102 to fill with steam and release heat, the air contained in the radiator needs to be expelled through the air outlet 130 of air vent 108. If the air outlet 130 of the air vent 108 is enclosed by an airtight enclosure 106, the air in the radiator 102 cannot be expelled, and steam will not flow into the radiator 102, and the radiator will not heat the room 100. If the actuator 114 opens the adjustable opening 118, the airtight seal is broken. When the adjustable opening 118 is open, air in the radiator 102 can be expelled through the air outlet 130 and then flow through the adjustable opening 118; this allows steam to flow into the radiator 102, thus heating the room 100.

In some embodiments, the present invention may include one or more wireless communication interfaces 128. Various embodiments of wireless communication interfaces may be provided including but not limited to Wi-Fi, Bluetooth, Bluetooth Low energy, Z-wave, and/or Zigbee. The radiator temperature control apparatus 104 can also receive control information from remote servers and/or devices through a wireless communication channel 150 and/or through the internet 152. The wireless communication may allow for remote and/or scheduled control of the radiator temperature control apparatus 104.

In some embodiments, the wireless communication interface 128 allows for remote calculations and/or algorithms to be performed based on information sent from the radiator temperature control apparatus 104 to a remote server and/or device connected to the internet 152. These remote algorithms and/or calculation are performed to better customize and control the regulation of heat within the room 100. These remote algorithms and/or calculations may directly control the radiator temperature control apparatus 104 and/or may update the configuration and/or control logic on the controller 116.

In some embodiments, the radiator temperature control apparatus 104 may include one or more environmental sensors 110 and/or 112. Environmental sensors 110 are outside of the airtight enclosure and measure the ambient environment; environmental sensors 112 are within and/or are configured to measure the environment within the airtight enclosure 106. These sensors may include temperature sensors, pressure sensors, and/or air flow sensors. The environmental sensors may be coupled with the controller 116 via a communication channel. In some embodiments, the environmental sensors may be connected to the internet 152 and/or remote devices and/or servers using the wireless communication interface 128 via a wireless communication channel 150.

In some embodiments, environmental sensors 112 include air flow sensors. The air flow sensors are coupled to the air outlet 130 of the air vent 108 and/or airtight enclosure 106 to determine if air is flowing from the air outlet 130.

In some embodiments, environmental sensors 112 include pressure sensors. The pressure sensors may be located within enclosure 106. In operation, with the adjustable opening 118 closed, as air flows from the air outlet 130 of the air vent 108, the pressure inside enclosure 106 will change; this pressure change will be detected by the pressure sensor 112.

In some embodiments, environmental sensors 110 and/or 112 include temperature sensors. Temperature sensors 110 are used to determine the ambient temperature of the room 100 and temperature sensors 112 are used to determine the temperature within the airtight enclosure 106.

In some embodiments, in operation, if the environmental sensors 110 indicate that the room 100 has a temperature below a given set point, the controller 116 will open the adjustable opening 118 by controlling the actuator 114. When the adjustable opening 118 is open, air can flow from the radiator 102 out of the air outlet 130 of the air vent 108, allowing steam to fill the radiator 102.

In some embodiments, the wireless communication interface 128 allows the radiator temperature control apparatus 104 to send information from sensors 110 and/or 112 and the status of actuator 114 to remote servers and/or devices connected to the internet 152 and/or through a wireless communication channel 150.

In some embodiments, the radiator temperature control apparatus 104 provides a local user interface 135. This may include buttons for input to alter set points and/or other configurations on the controller 116. Additionally, this may include a display to show information on the current configuration as well as information from the environmental sensors.

In some embodiments, the radiator temperature control apparatus 104 with a wireless communication interface 128 can connect to remote servers and/or devices through the internet 152 and/or via wireless communication channel 150. This connectivity allows the radiator temperature control apparatus 104 to be controlled by websites, web applications, and mobile applications.

In some embodiments, a remote sensing and control unit 120 is provided. In some embodiments, the remote sensing and control unit 120 contains a temperature sensor 124 to relay the ambient room temperature to the remote sensing and control unit controller 126, the radiator temperature control apparatus controller 116, and/or a remote server and/or device connected to the internet 152 and/or via a wireless communication channel 150. In some embodiments, the remote sensing and control unit 120 contains a wireless communication interface 128. In some embodiments, the remote sensing and control unit 120 contains a controller 126 to handle scheduling and to run calculations and/or algorithms used to better customize and control the regulation of heat within the room 100.

In some embodiments, the remote sensing and control unit 120 acts as a bridge between the internet 152 and the radiator temperature control apparatus 104. The remote sensing and control unit may have multiple wireless communication interfaces 128. In some embodiments, one wireless communication interface 128 connects to the internet 152 and another wireless communication interface 128 connects to the radiator temperature control apparatus 104. The controller 126 of the remote sensing and control unit 120 may relay the information between the two wireless communication interfaces 128.

In some embodiments, the remote sensing and control unit 120 provides for a local user interface 122. This may include buttons for input to alter set points and other configurations in the controller 126 and/or controller 116. Additionally, this may include a display to show information on the current configuration as well as information from the environmental sensors from the radiator temperature control apparatus 104 and/or the remote sensing and control unit 120.

Figure 2B:
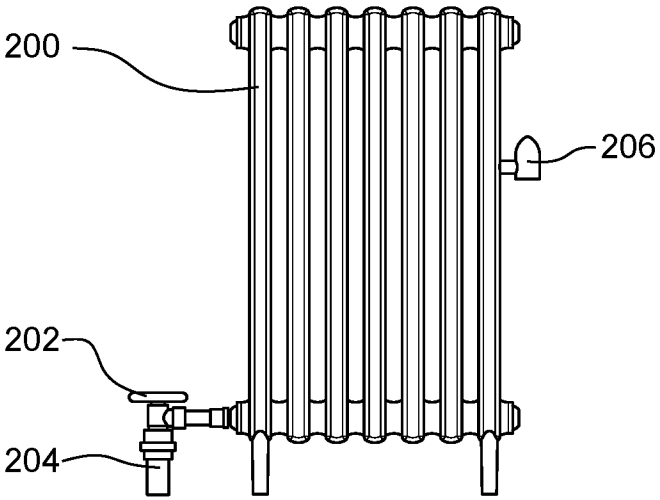
FIGS. 2A-B illustrate a one pipe steam radiator.
Figure 2A:
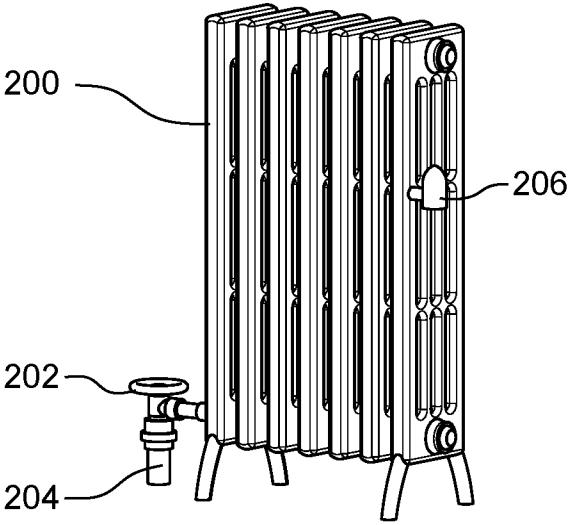

FIGS. 2A-B illustrate an existing one pipe steam radiator 200. The one pipe steam radiator 200 has a radiator valve 202, a steam inlet 204, and an air vent 206. In some embodiments, the radiator temperature control apparatus can control the heat released from radiator 200.

Figure 3B:
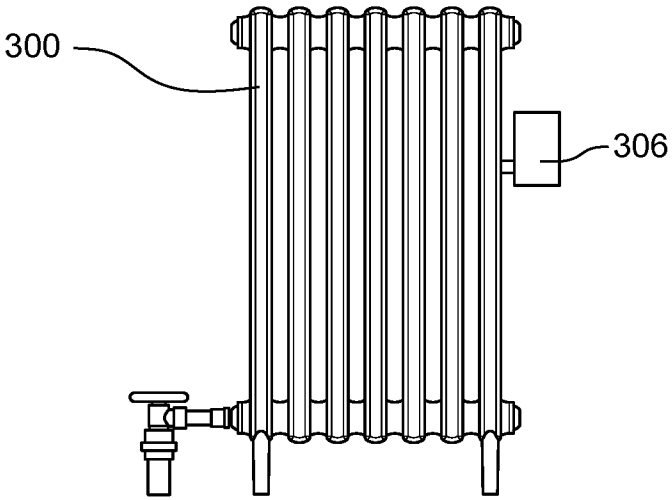
FIGS. 3A-B illustrate a one pipe steam radiator with an embodiment of a radiator temperature control apparatus.
Figure 3A:
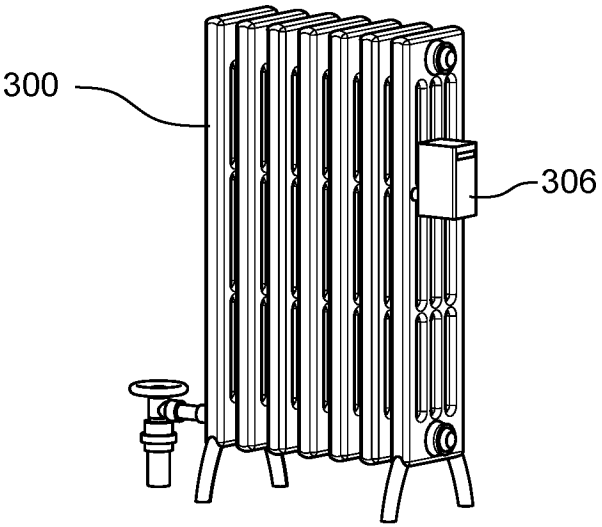

FIGS. 3A-B illustrate an existing one pipe steam radiator 300 with a radiator temperature control apparatus 306. In some embodiments, radiator temperature control apparatus 306 is affixed around the radiator air vent 206.

Figure 4:
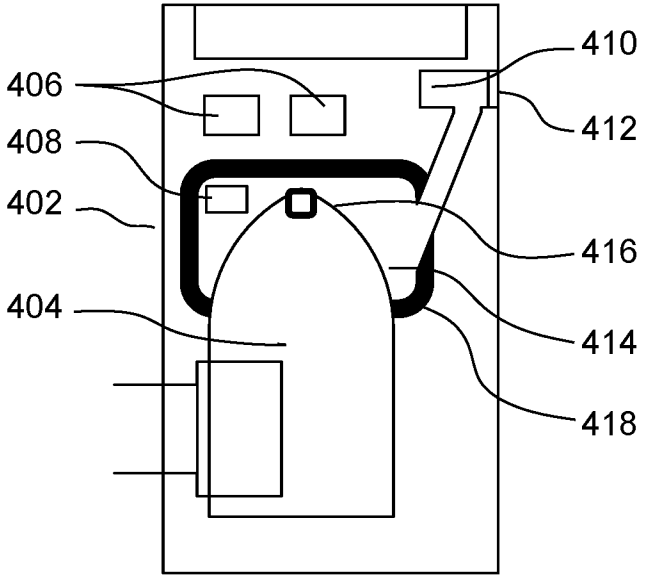
FIG. 4 is a diagram illustrating an embodiment of a radiator temperature control apparatus.

FIG. 4 is a diagram illustrating one embodiment of the radiator temperature control apparatus 402. In some embodiments, the airtight enclosure 414 is formed by sealing the portion of the radiator air vent 404 which contains the air outlet 416. In some embodiments the seal 418 may be created with closed cell foam. In some embodiments, there may be environmental sensors 408 within the airtight enclosure 414 configured to measure temperature, pressure, and/or air flow. In some embodiments, there may be environmental sensors 406 outside of the airtight enclosure 414 configured to measure the ambient environment. In some embodiments, the airtight enclosure 414 is extended to connect to the adjustable opening 412. The adjustable opening 412 is controlled by the actuator 410.

Figure 5:
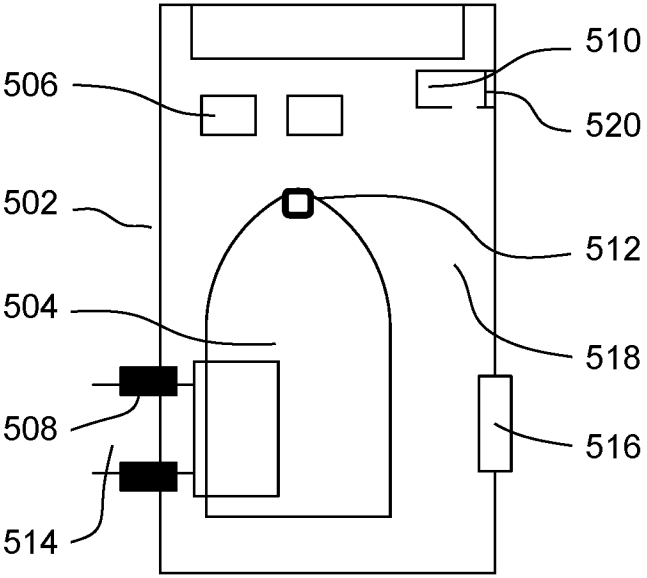
FIG. 5 is a diagram illustrating an embodiment of a radiator temperature control apparatus.

FIG. 5 is a diagram illustrating one embodiment of the radiator temperature control apparatus 502. In some embodiments, the airtight enclosure is created by sealing the neck 514 of the air vent 504. In some embodiments the seal 508 may be created with closed cell foam. The space within the radiator temperature control apparatus 502 becomes the airtight enclosure 518. In some embodiments there may be environmental sensors 506 within the airtight enclosure 518 configured to measure temperature, pressure, and/or air flow. In some embodiments, there may be environmental sensors 516 outside of the airtight enclosure configured to measure the ambient environment. In some embodiments, the adjustable opening 520 is controlled by the actuator 510.

Figure 6:
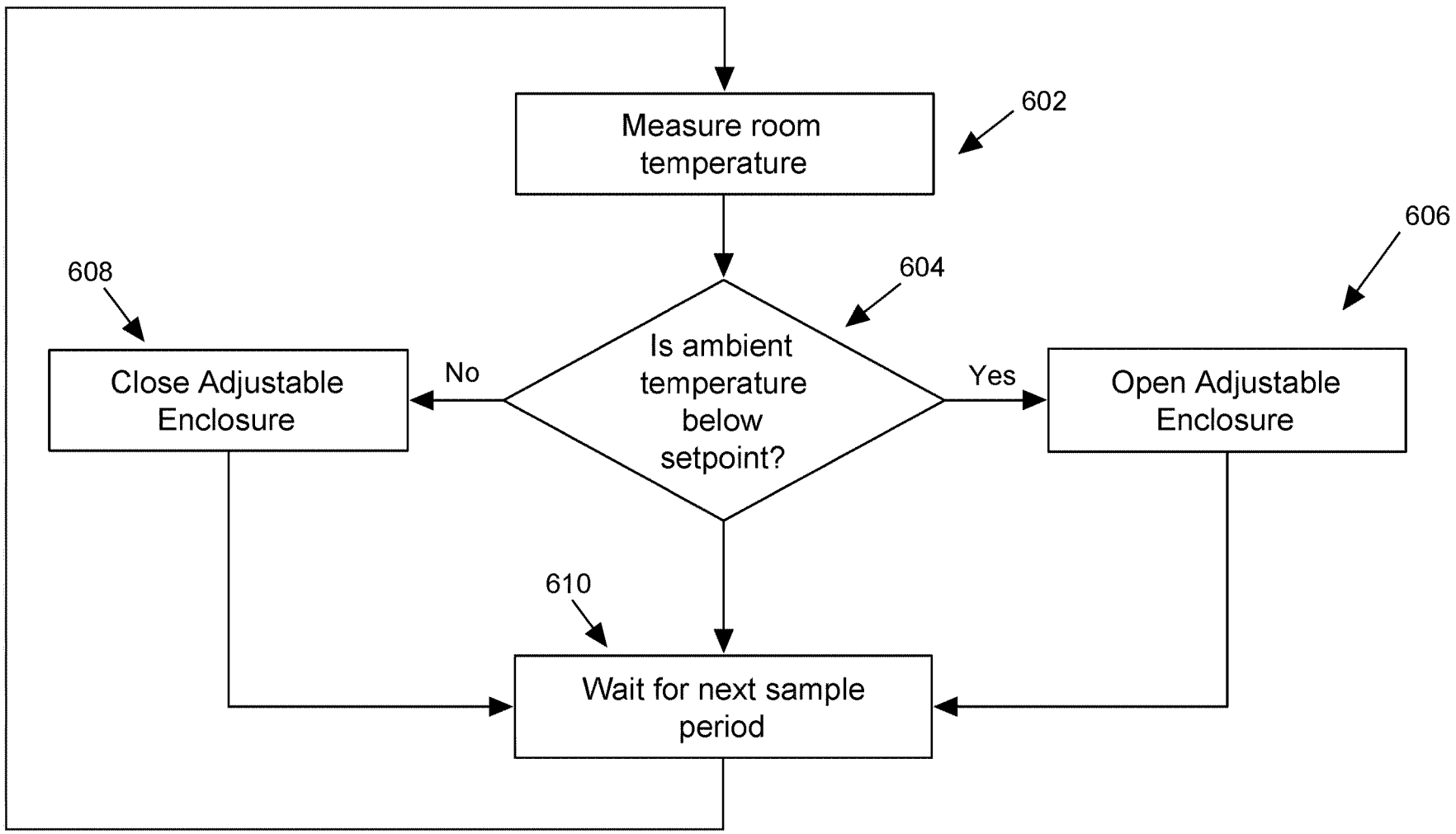
FIG. 6 is a flow diagram illustrating an example of the operation of a radiator temperature control apparatus.

FIG. 6 is a flow diagram illustrating an example of operating a radiator temperature control apparatus. At 602 a controller measures ambient temperature of a room. At 604, the controller compares a desired set point to the measured ambient temperature. In some embodiments, the desired set point is preconfigured on the controller. In other embodiments, the user can program a desired set point in the controller.

If the ambient temperature is below the desired set point, at 604 the radiator temperature control apparatus can open the adjustable opening in the airtight enclosure around the air outlet of radiator air vent 606, such that during a heating cycle, the radiator will expel air and fill with steam. At 610, the controller can wait for the next sample period and then proceed to 602.

If the ambient temperature is not below the desired set point, at 604 the radiator temperature control apparatus can close the adjustable opening in the enclosure around the radiator air vent 608, such that during a heating cycle, the radiator will not expel air and will not fill with steam. At 610, the controller can wait for the next sample period and then proceed to 602.

Figure 7:
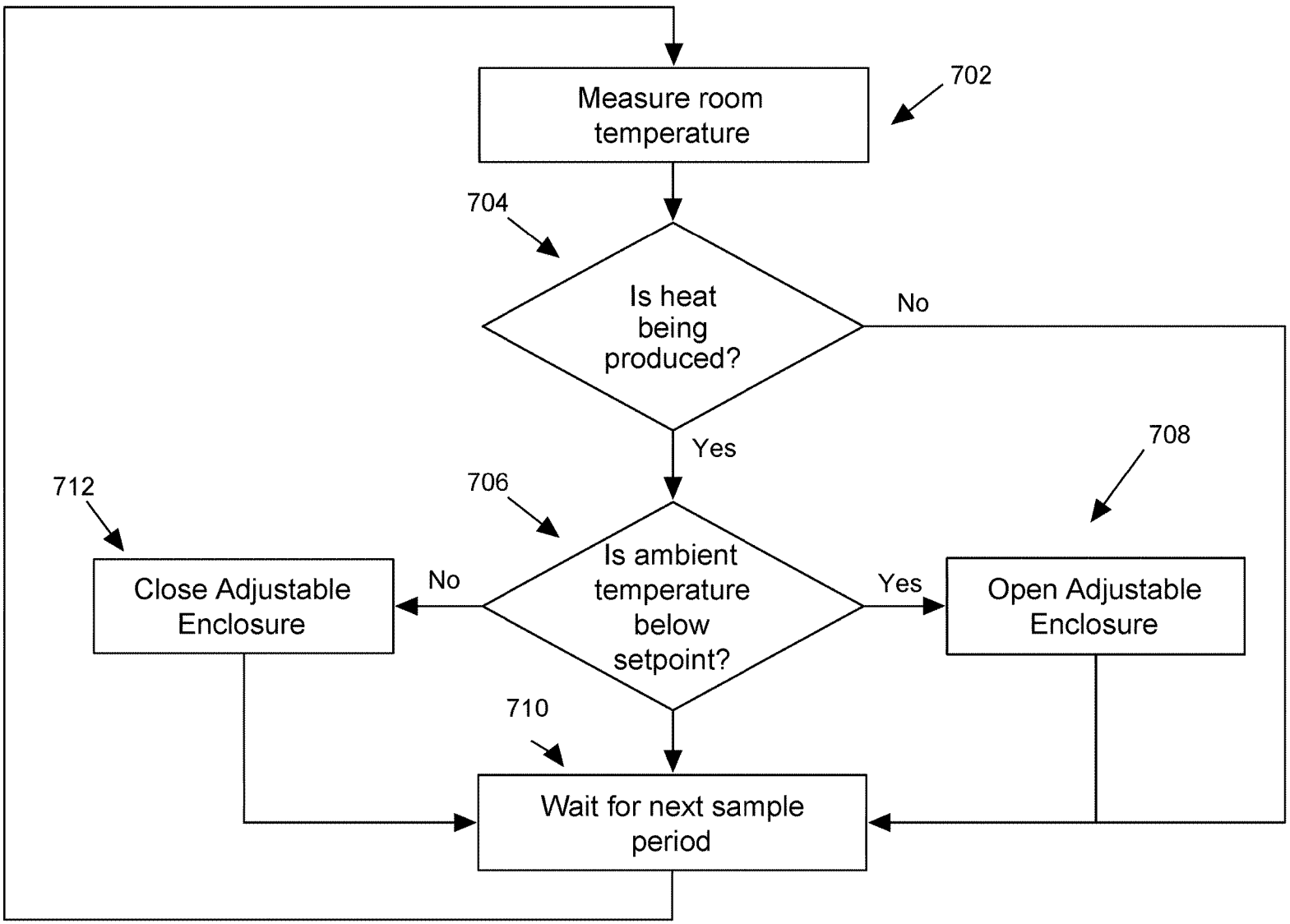
FIG. 7 is a flow diagram illustrating an example of the operation of a radiator temperature control apparatus.

FIG. 7 is a flow diagram illustrating an example of operating a radiator temperature control apparatus. In this example, the operating of a radiator temperature control apparatus checks to see if heat is being produced before acting on the adjustable opening. At 702 a controller measures ambient temperature of a room. At 704 a controller determines if heat is being produced. In some embodiments, the air flow and/or pressure sensors are used to detect if air is trying to and/or is flowing from the air outlet of the radiator air vent. If heat is not being produced, the controller can wait for the next sample period 710 and then proceed to 702. If heat is being produced, at 706 the controller compares a desired set point to the measured ambient temperature. In some embodiments, the desired set point is preconfigured on the controller. In other embodiments, the user can program a desired set point in the controller.

If the ambient temperature is below the desired set point, at 706 the radiator temperature control apparatus can open the adjustable opening in the airtight enclosure around the air outlet of the radiator air vent 708, such that during a heating cycle, the radiator will expel air and fill with steam. At 710, the controller can wait for the next sample period and then proceed to 702.

If the ambient temperature is not below the desired set point, at 706 the radiator temperature control apparatus can close the adjustable opening in the airtight enclosure around the air outlet of the radiator air vent 712, such that during a heating cycle, the radiator will not expel air and will not fill with steam. At 710, the controller can wait for the next sample period and then proceed to 702.

Figure 8:
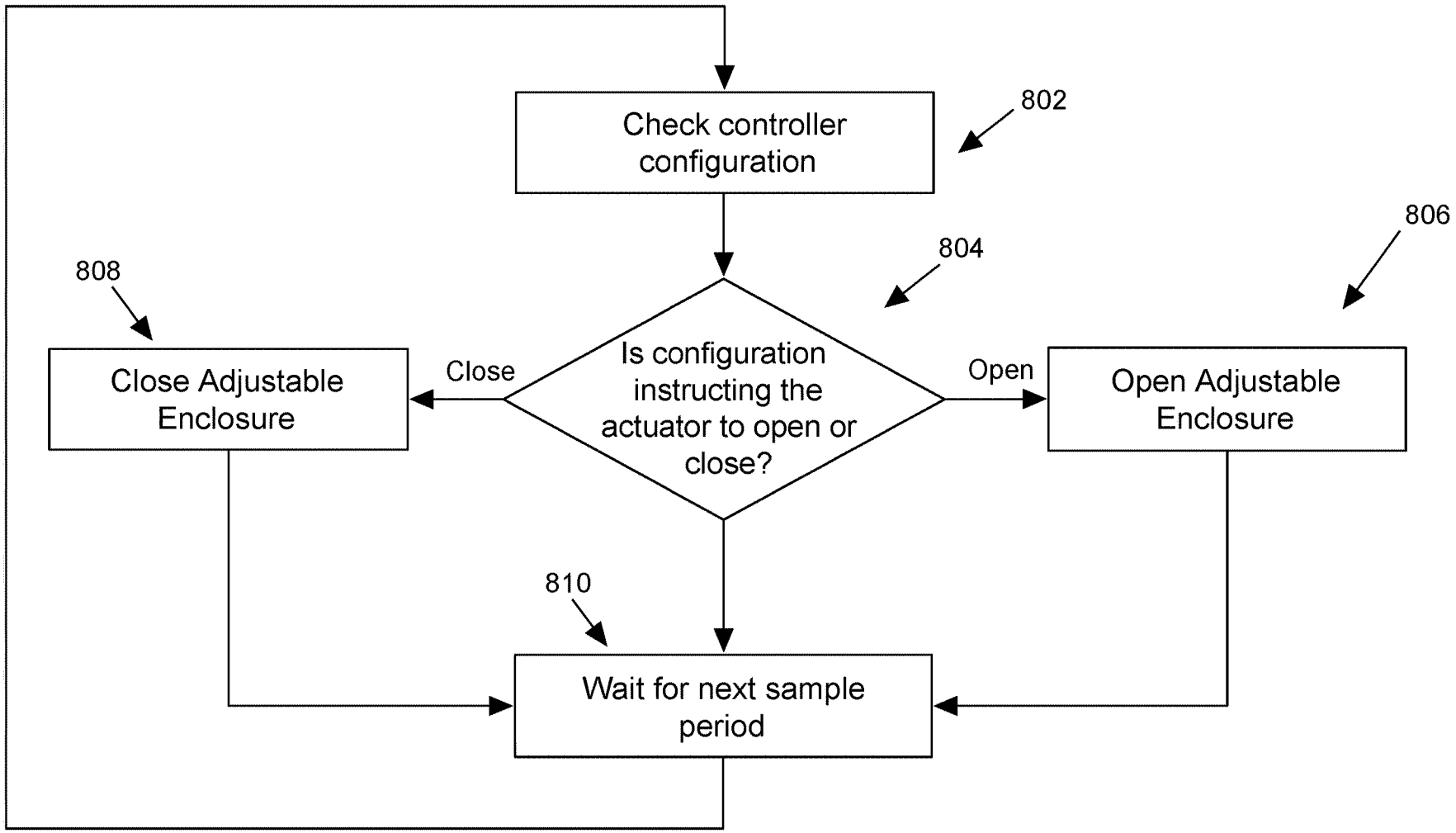
FIG. 8 is a flow diagram illustrating an example of the operation of a radiator temperature control apparatus.

FIG. 8 is a flow diagram illustrating an example of operating a radiator temperature control apparatus. At 802 the controller checks its configuration to see if the configuration is instructing the adjustable opening to open or close. At 804, if the controller is instructing the adjustable opening to open, the radiator temperature control apparatus can open the adjustable opening in the airtight enclosure around the air outlet of the radiator air vent 806, such that during a heating cycle, the radiator will expel air and fill with steam. At 810, the controller can wait for the next sample period and then proceed to 802. At 804, if the controller is instructing the adjustable opening to close, the radiator temperature control apparatus can close the adjustable opening in the airtight enclosure around the air outlet of the radiator air vent 808, such that during a heating cycle, the radiator will not expel air and will not fill with steam. At 810, the controller can wait for the next sample period and then proceed to 802. In some embodiments, the controller configuration is set by a user, for example, on a programmable schedule. In alternate embodiments, the controller's configuration is set by a remote server and/or device. That remote server and/or device may use various environmental sensors to determine what settings to include in the controller's configuration, for example using external temperature and/or a remote ambient temperature sensor.

In some embodiments, additional steps can be added to FIG. 6, 7, 8 to check to see if the adjustable opening is already open or closed before proceeding to open or close the adjustable opening. If the adjustable opening is determined to already be in the desired state, the system will not take action on the actuator and wait for the next sample period.

Figure 9A:
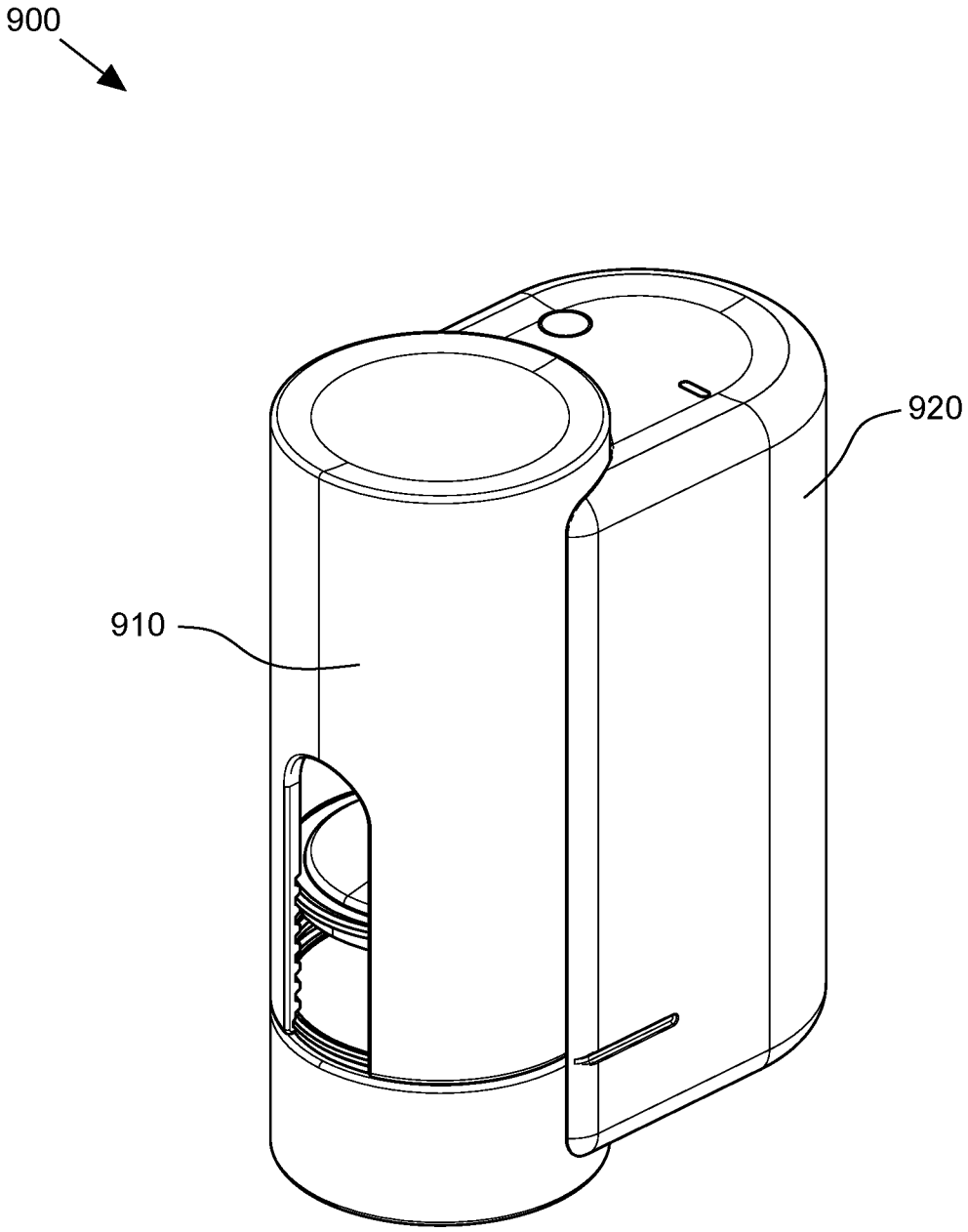
FIG. 9A shows a perspective view of a second embodiment of a radiator temperature control apparatus.
Figure 9B:
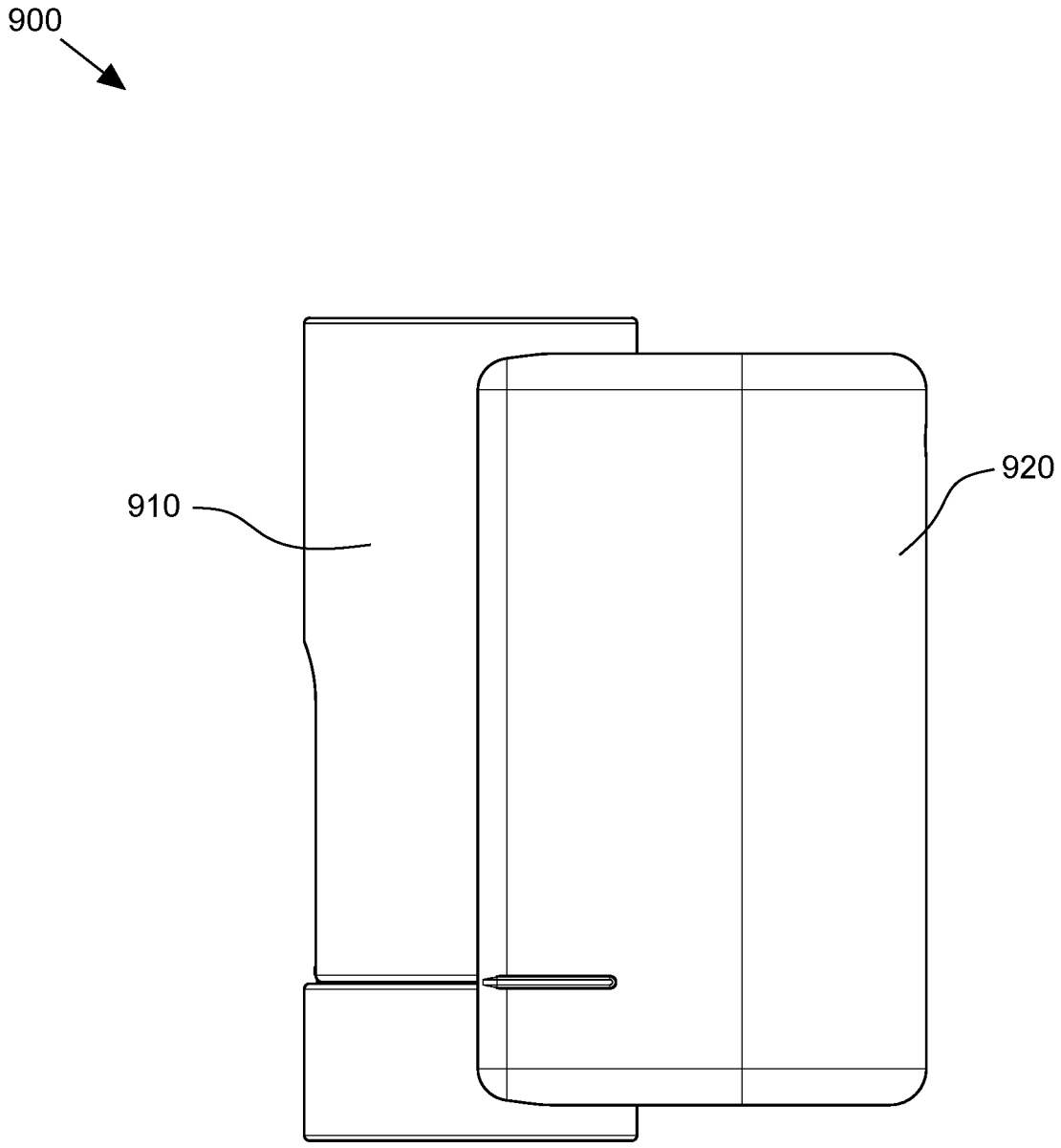
FIG. 9B shows a side view of the radiator temperature control apparatus of FIG. 9A.
Figure 9C:
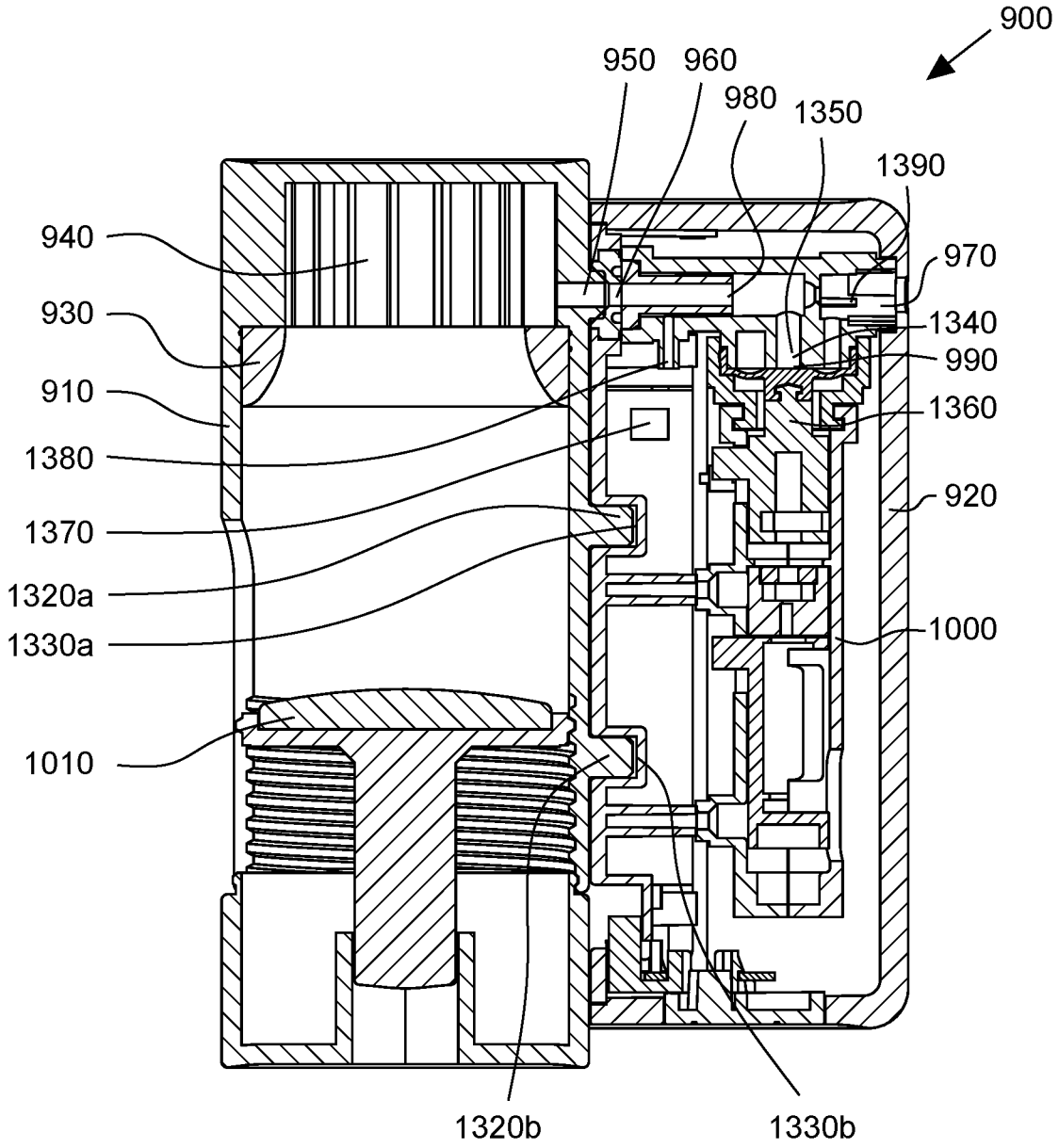
FIG. 9C shows a sectioned view of the second embodiment of the radiator temperature control apparatus shown in FIG. 9A.

FIG. 9A shows a perspective view of a second embodiment of a radiator temperature control apparatus 900. FIG. 9B shows a side view of the radiator temperature control apparatus 900 of FIG. 9A, and FIG. 9C shows a sectioned view of the second embodiment of the radiator temperature control apparatus shown in FIG. 9A.

As shown, the second embodiment of the radiator temperature control apparatus 900 comprises a first housing 910 for enclosing at least a portion of a radiator air vent and a second housing 920 separate from the first housing. The radiator air vent discussed herein is typically an existing radiator air vent of a system to which the radiator temperature control apparatus 900 discussed herein is being applied. It will be understood that the first housing 910 and second housing 920 referred to herein typically comprise an outer housing or casing and various interior components. Accordingly, when referencing the second housing, for example, such reference is not intended to reference only the outer housing of the component.

The first housing 910 is generally a passive housing that encloses a radiator air vent, as shown below in FIGS. 11A-12B, and comprises a sealing mechanism 930 for forming a seal about an air outlet of the radiator air vent. When applied to the radiator air vent, an internal chamber 940 is formed within the first housing 910, and the chamber is sealed at least partially by the sealing mechanism 930 against the radiator air vent. The first housing 910 may be substantially cylindrical, and may be configured and sized to retain existing radiator air vents that are similarly cylindrical or otherwise axially symmetric.

The first housing further comprises a fluid outlet 950 in a wall of the internal chamber 940 through which fluid, such as air, exiting the air outlet of the radiator air vent may exit the first housing 910.

The second housing 920 is independent and separable from the first housing 910, and the second housing typically comprises a fluid inlet 960, a fluid outlet 970, and a fluid path 980 between the fluid inlet and the fluid outlet. The second housing 920 further comprises a blockage 990 for preventing fluid entering the second housing at the fluid inlet 960 from exiting the housing at the fluid outlet 970, and an actuator 1000 for opening and closing the blockage 990.

When the first housing 910 is applied to a radiator air vent and the second housing 920 is applied to the first housing, the first housing encloses at least a portion of the radiator air vent, as discussed below, and the second housing is fixed to the first housing such that the fluid outlet 950 of the first housing is in fluid communication with the fluid inlet 960 of the second housing.

Figure 10C:
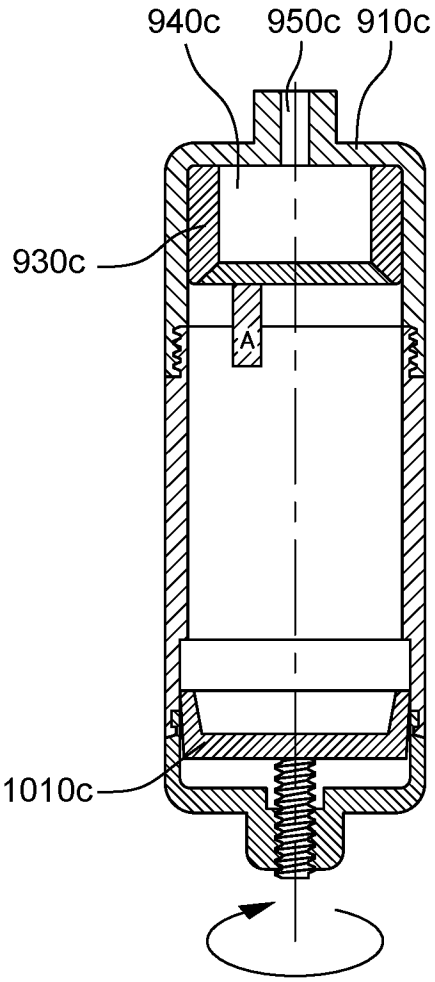
FIGS. 10A-10C show schematic diagrams of three examples of first housings to be used in the embodiment of the radiator temperature control apparatus of FIG. 9A.
Figure 10B:
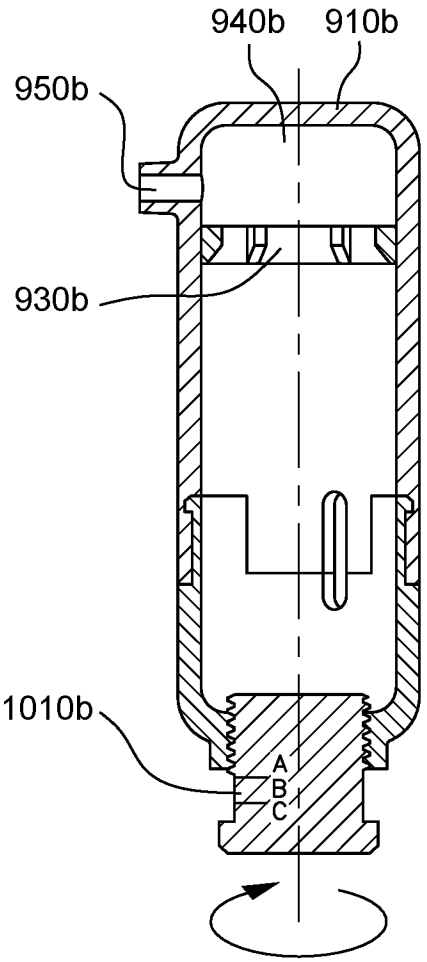
Figure 10A:
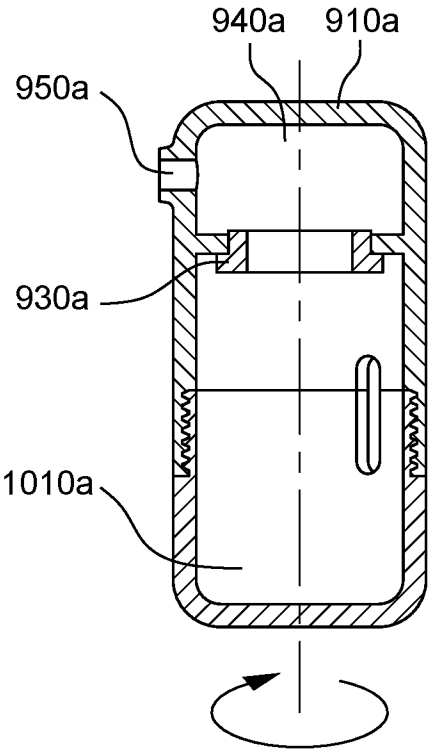

FIGS. 10A-10C show schematic diagrams of three examples of first housings 910*a, b, c* to be used in the embodiment of the radiator temperature control apparatus of FIG. 9A. As shown, each embodiment provides a sealing mechanism 930*a, b, c*, typically in the form of a gasket, which forms a seal about an existing radiator air vent. Each embodiment further comprises an internal chamber 940*a, b, c* formed when sealed against the radiator air vent by way of the gasket 930*a, b, c*. Each embodiment similarly comprises a fluid outlet 950*a, b, c* through which fluid can exit the internal chamber 940*a, b, c*.

As shown in FIGS. 10A-10C, the first housing further comprises a retainer 1010*a, b, c* for compressing the portion of the radiator air vent contained therein against the corresponding gasket 930*a, b, c*. In FIG. 10A, the retainer 1010*a* may be a second half of the first housing which may be connected to the rest of the first housing 910*a* by way of threading at a cylindrical perimeter of the housing.

As shown in FIG. 10B, the retainer 1010*b* may be a plunger formed from the base of a compression screw. The compression screw 1010*b* may be provided with settings, as shown, such that the screw could be set to different locations to accommodate different types of radiator air vents.

As shown in FIG. 10C, the retainer 1010*c* may be a plunger fixed to a lead screw mechanism for lifting the plunger to a desired location. As such, a base component of the first housing 910 may be a dial for rotating the lead screw, thereby raising the plunger.

Just as a variety of retainers 1010*a, b, c* are contemplated, so too a variety of gaskets 930*a, b, c* are contemplated. Similarly, the first housing 910*a, b, c* may be sealed about the radiator air vent in a variety of ways. Accordingly, while the first housing 910*a, b, c* is shown as fully surrounding the radiator air vent, in some embodiments, only a portion of the radiator air vent is enclosed therein, so long as the internal chamber 940*a, b, c* may be formed within the first housing.

FIGS. 11A-11D show one example of the first housing 910 used to enclose two distinct existing radiator air vent designs.

Figure 11A:
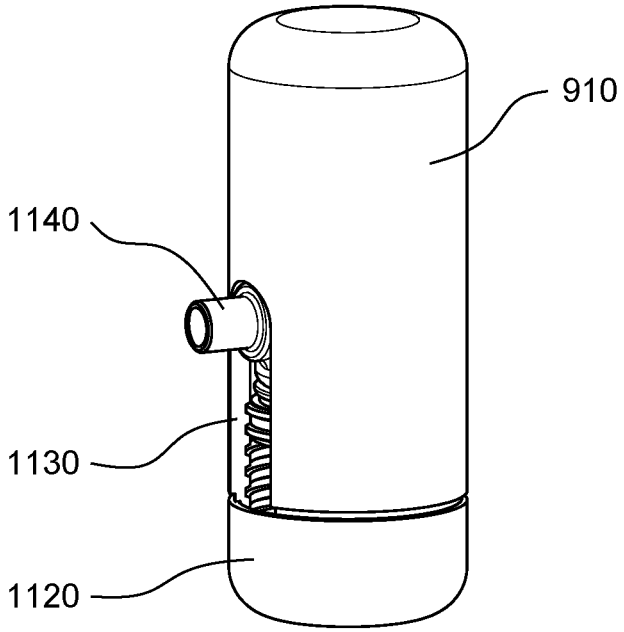
FIG. 11A shows a first housing to be used in the embodiment of the radiator temperature control apparatus of FIG. 9A mated with a first example of an existing radiator air vent.
Figure 11B:
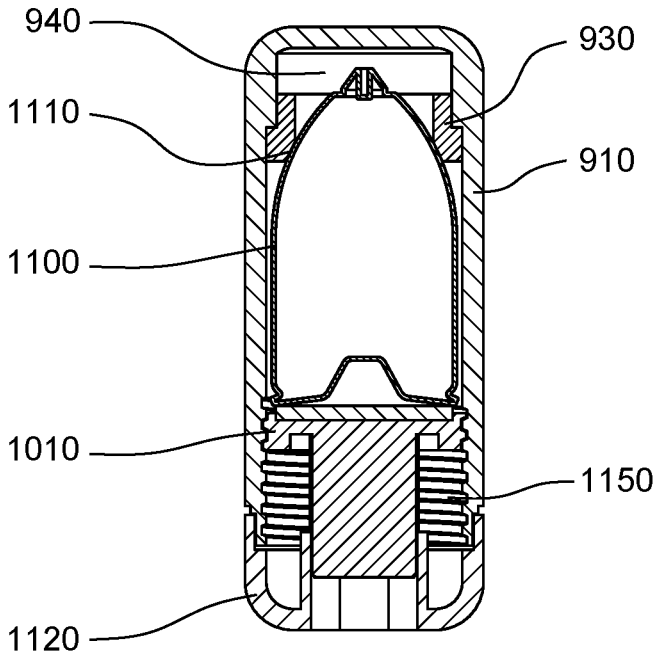
FIG. 11B shows a sectioned view of the first housing of FIG. 11A mated with the first example of an existing radiator air vent.

Accordingly, FIG. 11A shows a first housing 910 to be used in the embodiment of the radiator temperature control apparatus of FIG. 9A mated with a first example of an existing radiator air vent 1100. FIG. 11B shows a sectioned view of the first housing of FIG. 11A mated with the first example of an existing radiator air vent. The example shown in FIGS. 11A-11B is a bullet shaped radiator air vent 1100. Such a bullet shaped vent 1100 is typical of traditional air vent designs, and has a tapered upper edge 1110 leading to an upwards facing fluid outlet.

As shown, the gasket 930 of the first housing 910 forms a seal against the tapered upper edge 1110 of the bullet shaped vent 1100. Accordingly, the upper end of the first housing 910 combines with the gasket 930 and the tapered upper edge 1110 of the vent to form the internal chamber 940. An air outlet 950, not shown in FIGS. 10A-10B, is therefore the only way for fluid, typically air, leaving the vent 1100 to leave the internal chamber 940.

A bottom portion 1120 of the first housing is provided to seal the first housing 910 about the vent 1100, and a slot 1130 is provided in a wall of the first housing 910 to allow for a vent inlet 1140 to enter the housing. The bottom portion 1120 may be fixed to the first housing 910 in a variety of ways, such as by screwing the component to the first housing, or by a press fit or a spring loaded snap fit. A plunger 1010 is provided as the retainer discussed above, and is held in place by the lower housing 1120. The plunger 1010 can then be adjusted upwards or downwards along threading 1150 within the first housing 910 in order to compress the vent 1100 against the gasket 930, thereby forming a tight seal.

Figure 11C:
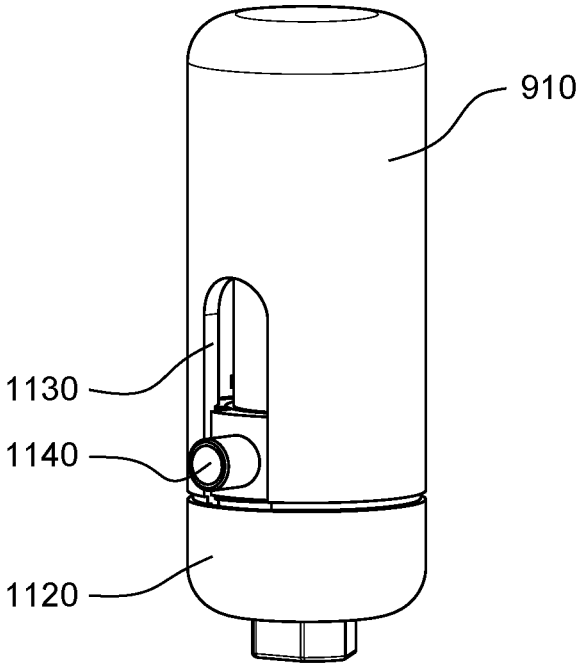
FIG. 11C shows the first housing of FIG. 11A mated with a second example of an existing radiator air vent.
Figure 11D:
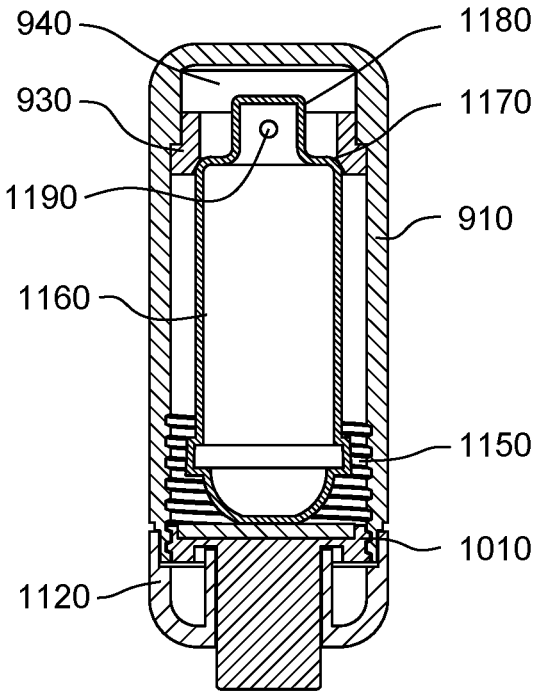
FIG. 11D shows a sectioned view of the first housing of FIG. 11A mated with the second example of an existing radiator air vent.

FIG. 11C shows the first housing 910 of FIG. 11A mated with a second example of an existing radiator air vent 1160. FIG. 11D shows a sectioned view of the first housing 910 of FIG. 11A mated with the radiator air vent 1160 shown in FIG. 11C.

As shown, the vent 1160 is a cylindrical vent, which is a second standard vent design to which the first housing 910 may be retrofitted. As shown, the vent 1160 may have a size change in its diameter 1170 at an upper extremity of the vent body, and the gasket 930 may then seal against that size change. The upper extremity 1180 of the vent 1160 then contains a vent outlet 1190.

Accordingly, the upper end of the first housing 910 combines with the gasket 930 and the size change 1170 of the vent 1160 to form the internal chamber 940. Accordingly, the upper extremity 1180 of the vent 1160 is contained within the internal chamber 940, and an air outlet 950, not shown in FIGS. 10C-10D, is the only way for fluid leaving the vent 1160 to leave the internal chamber 940.

As in the case of the bullet shaped vent 1100, a vent inlet 1140 enters the first housing 910 by way of the slot 1130 provided in the wall of the housing, and the plunger 1010 retains the vent 1160 within the housing. However, as the bullet shaped vent 1100 and the cylindrical vent 1160 are different sizes, the vent inlet 1140 is positioned at a different location along the slot 1130 and the plunger 1010 is tightened to a different location along the threading 1150. As such, the adjustability of the plunger 1010 and the length of the slot 1130 provide adjustability to apply the first housing to a variety of different traditional vent designs.

In some embodiments, the first housing 910 is part of a system in which several distinct passive housings may be provided to adapt to a wide variety of existing vent designs.

Figure 12B:
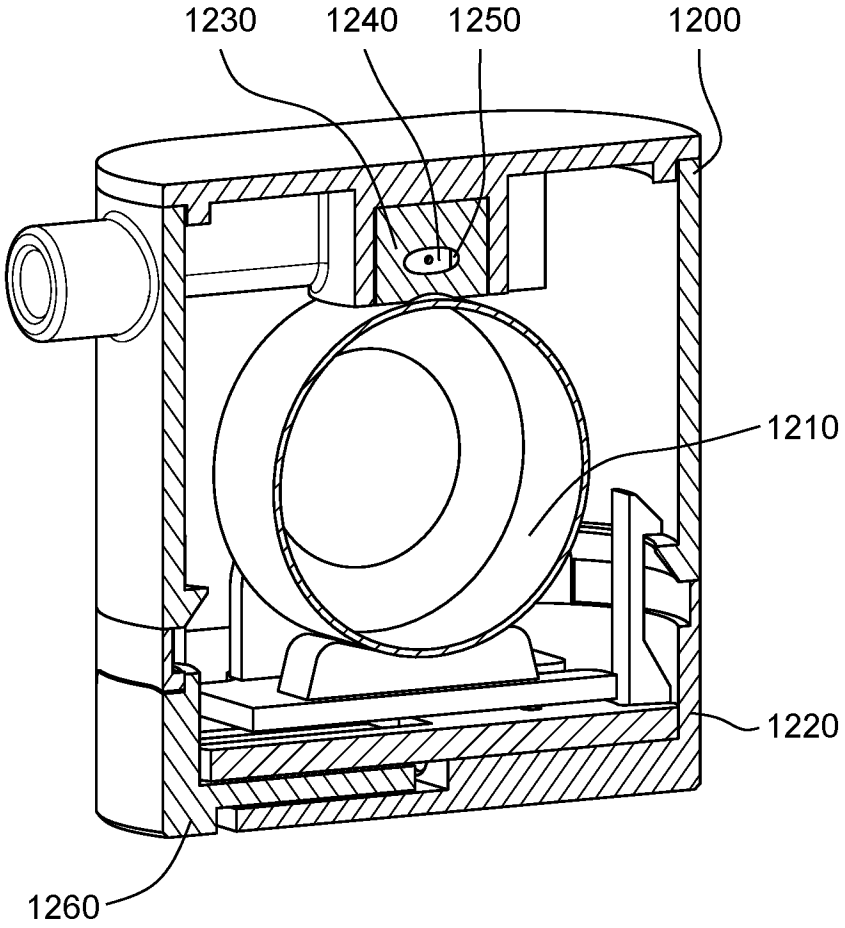
FIG. 12B shows a sectioned view of the alternative example of a first housing shown in FIG. 12A.
Figure 12A:
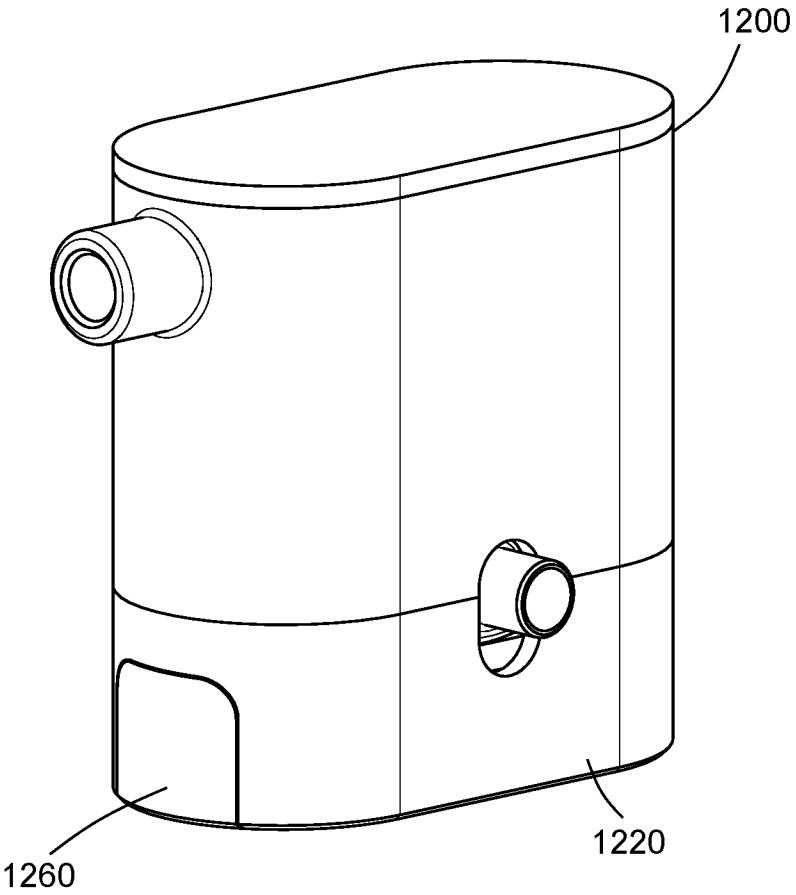
FIG. 12A shows an alternative example of a first housing to be used in the embodiment of the radiator temperature control apparatus of FIG. 9A mated with a third example of an existing radiator air vent.

FIG. 12A shows an alternative example of a housing 1200 to be used in place of the first housing 910 shown in FIGS. 11A-11D in the radiator temperature control apparatus 900 of FIG. 9A mated with a third example of an existing radiator air vent 1210. FIG. 12B shows a sectioned view of the housing 1200 shown in FIG. 12A. As shown, the housing 1200 is not cylindrical, and is designed to accommodate an angle mounted Gorton® vent 1210. As in the first housing 910, the vent is captured by a two part housing 1200, including a bottom portion 1220. A gasket 1230 is provided at an upper end of the housing 1200 such that an upper element, such as a venting tower 1240, of the vent 1210 is captured within, or above, the gasket 1230. An internal chamber 1250 is formed about the upper element 1240, such that the fluid outlet of the vent 1210 vents to within the chamber.

Figure 15A:
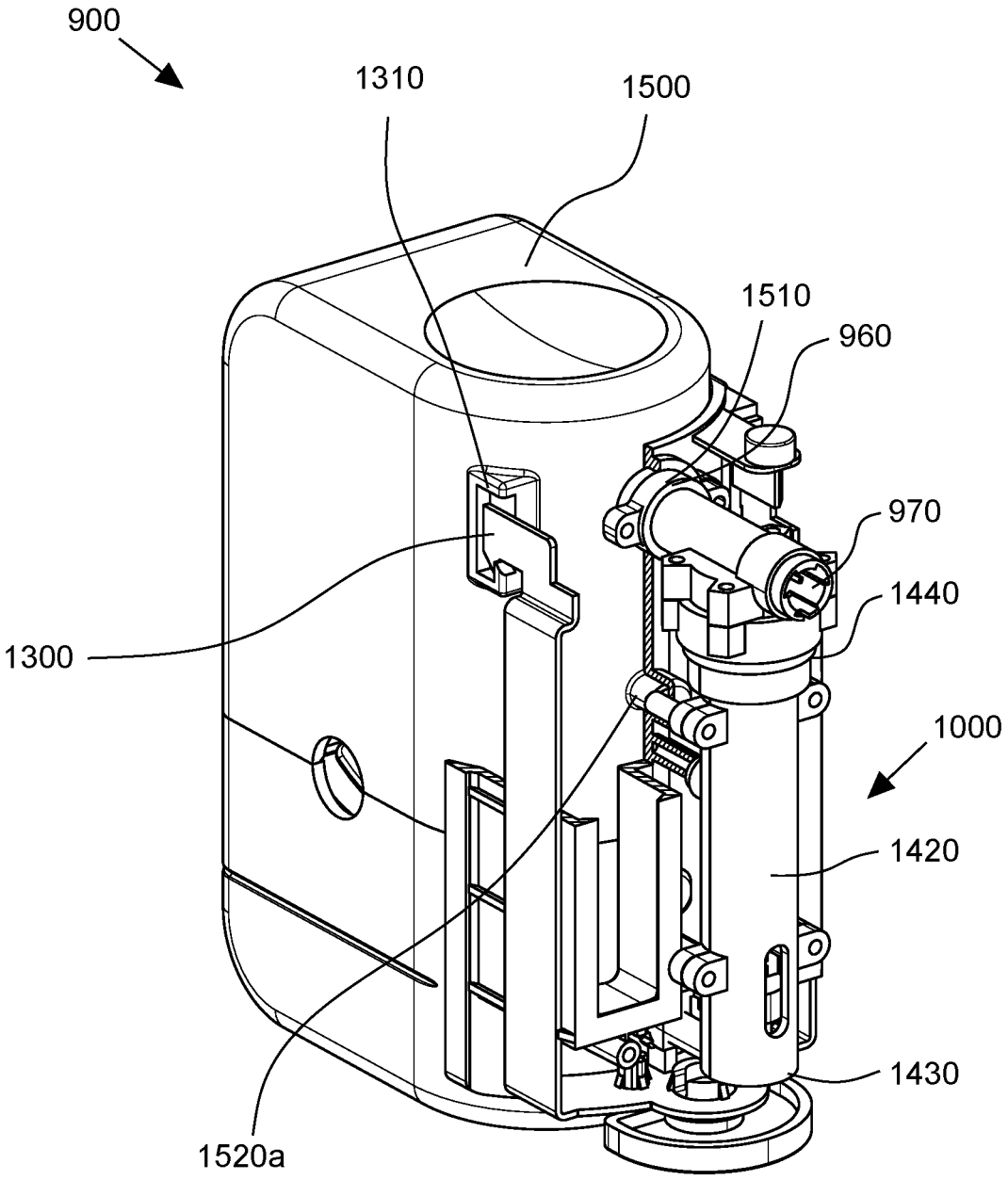
FIG. 15A shows a perspective view of the radiator temperature control apparatus of FIG. 9 in use with an alternative example of a first housing with an outer casing of the second housing removed.
Figure 15B:
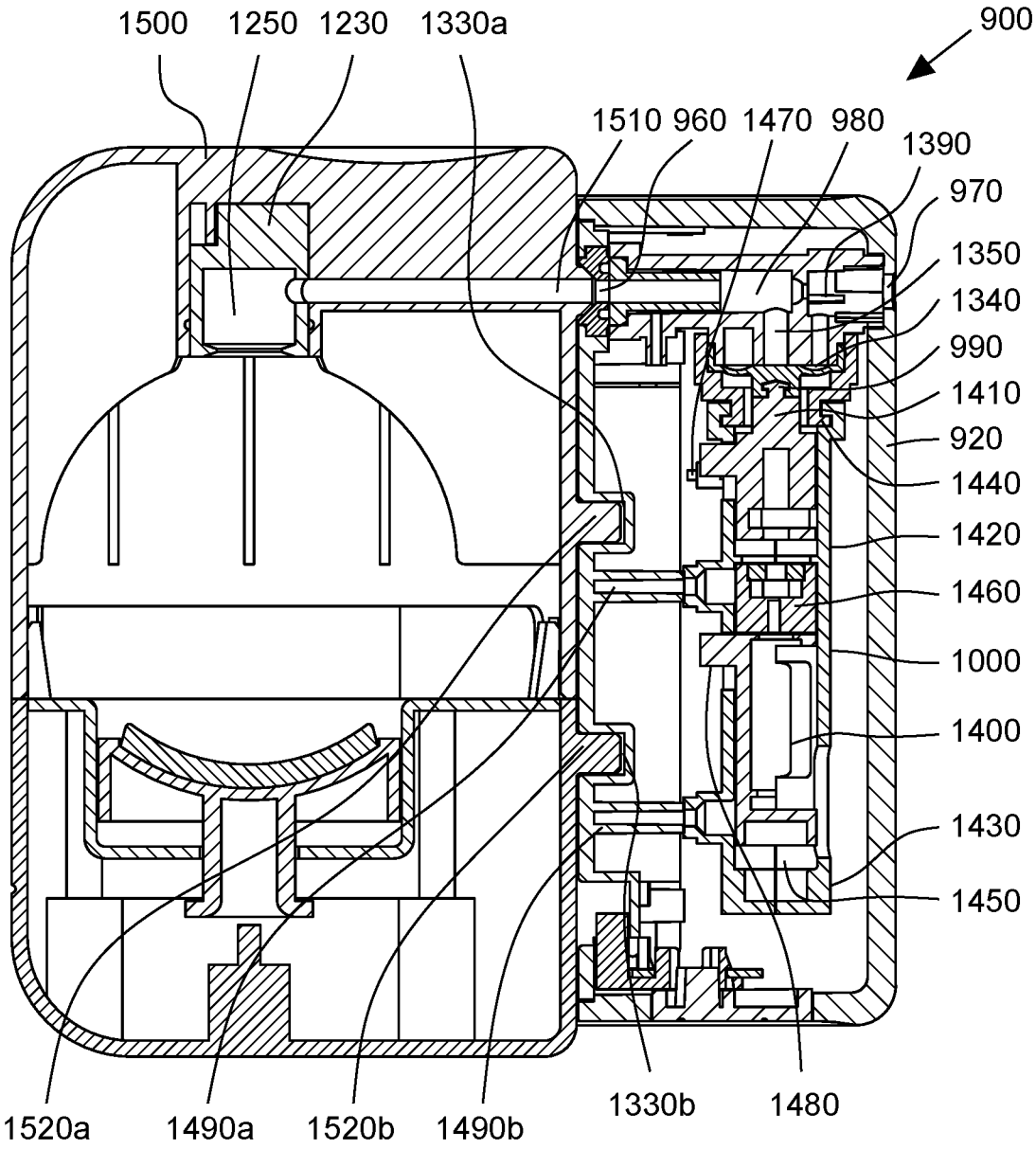
FIG. 15B shows a sectioned view of the radiator temperature control apparatus of FIG. 15A.

It will be understood that while 12A shows a specific alternative housing 1200 to be used in place of the first housing, wherein the alternative housing is designed for mating with a specific set of Gorton® vents 1210, a variety of alternative housings may be made as part of a system described herein. Accordingly, a user having a traditional vent design already installed can select an appropriate first housing 910, 1200 while the standardized second housing 920 can mate with whichever first housing 910 is selected. Another example of a first housing 1500 for mating with the Gorton® vent 1210 shown is shown in FIGS. 15A-15B mated with a second housing 920.

To establish a seal, a spring loaded bottom plate integrated into the bottom housing 1220 compresses the venting tower 1240 against the gasket 1230. The top and bottom housings 1200, 1220 are held together with a spring-loaded snap fit, which simplifies the installation procedures. As shown, a release button 1260 may be located on the housing for releasing the bottom portion of the housing 1220 from the main housing 1200. The button 1260 may be located at a location on the first housing not accessible when the second housing 920 is applied thereto, so as to avoid an unintended uninstallation of the first housing 1200. A similar release button and configuration may be provided with respect to the first housing 910 discussed above.

Figure 13A:
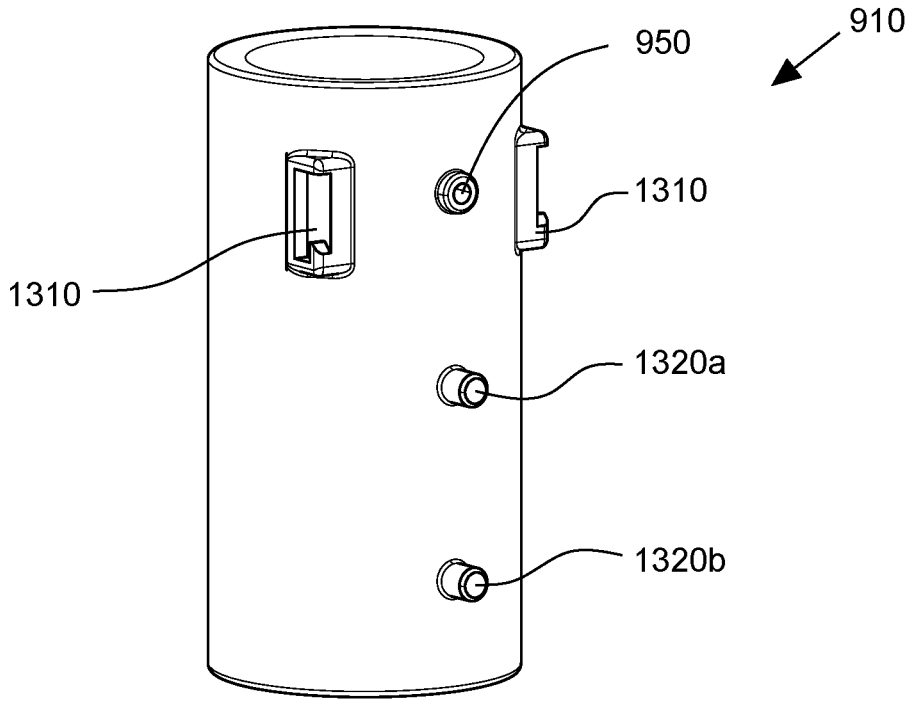
FIG. 13A shows a first housing of the embodiment of FIG. 9A
Figure 13B:
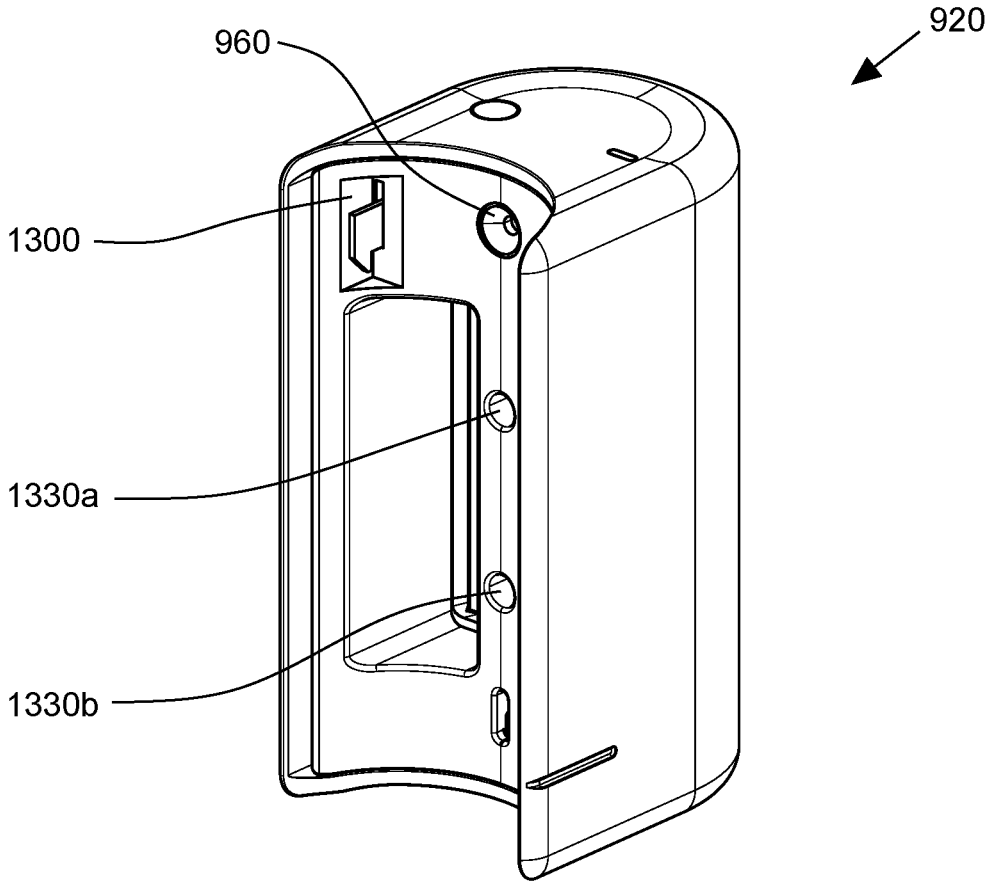
FIG. 13B shows a second housing to be mated with the first housing in the embodiment of the temperature control apparatus of FIG. 9A.

FIG. 13A shows a first housing 910 for use in the embodiment of FIG. 9A and FIG. 13B shows a second housing 920 to be mated with the first housing in the embodiment of the temperature control apparatus 900 of FIG. 9A. As shown in FIG. 9C, the second housing 920 is applied to the first housing 910 such that the fluid outlet 950 of the first housing is in fluid communication with the fluid inlet 960 of the second housing.

The second housing 920 includes a fixation mechanism 1300 for fixing to a corresponding fixation point 1310 of the first housing 910. The first housing 910 further comprises locating pins 1320*a, b* which mate with corresponding cavities 1330*a, b* in the second housing 920. Accordingly, the fixation mechanism 1300 and cavities 1330*a, b* locate the second housing 920 such that the fluid inlet 960 is properly located adjacent the fluid outlet 950 of the first housing 910.

Returning now to FIG. 9C, the second housing 920 has a fluid inlet 960, a fluid outlet 970, and a fluid path 980 between the fluid inlet and the fluid outlet. The second housing 920 further comprises a blockage 990 for preventing fluid entering the second housing at the fluid inlet 960 from exiting the housing at the fluid outlet 970, and an actuator 1000 for opening and closing the blockage 990.

As shown, the second housing may have a fluid chamber 1340 (shown sealed in FIG. 9C and open in FIG. 14A), and the fluid inlet 960 may deposit fluid into the fluid chamber. The fluid inlet 960 may then comprise a terminal end 1350 adjacent the fluid chamber 1340. The blockage 990 is then a membrane adjacent the terminal end 1350 of the fluid inlet 960 which may seal the membrane against the terminal end. The fluid outlet 970 may then extend from the fluid chamber 1340 to an exterior of the second housing 920.

The actuator 1000 may comprise a shaft 1360 for applying force to seal the membrane 990 against the terminal end 1350 of the fluid inlet 960.

In some embodiments, the radiator temperature control apparatus 900 further comprises a pressure sensor 1370 for detecting pressure within the fluid path 980. In such an embodiment, the pressure sensor 1370 may detect pressure in the fluid path 980 between the fluid inlet 960 and the blockage 990. The pressure sensor 1370 may then be located outside of the fluid path 980 but may be functionally linked to the fluid path by way of a probe, such as the passageway 1380 shown, such that it may detect pressure within the path.

As discussed above with respect to other embodiments, the radiator temperature control apparatus 900 may further comprise a controller, or control circuitry, for controlling the actuator, and the controller may receive pressure information from the pressure sensor 1370 and may receive ambient temperature information from a space to be heated by the radiator, and the controller may then cause the actuator 1000 to open the blockage 990 if the ambient temperature is below a set temperature threshold and the pressure information indicates a pressure above a threshold pressure within the fluid path 980.

Similarly, alternative methods may be implemented in which the pressure readings from the pressure sensor 1370 and the ambient temperature are used to determine whether to open or close the blockage 990 by way of the actuator 1000 and at what time.

In some embodiments, in addition to or in place of the pressure sensor 1370, an air flow sensor or a microphone 1390 is provided for detecting air flow in the fluid path 980. In such an embodiment, the microphone or air flow sensor 1390 may be located so as to detect air flow in the fluid path 980 between the blockage 990 and the fluid outlet 970.

In such an embodiment, the controller or control circuitry, provided for controlling the actuator may receive air flow information from the microphone or air flow sensor and ambient temperature information from a space to be heated by the radiator, and the controller may cause the actuator 1000 to close the blockage 990 if the ambient temperature is above a set temperature threshold and the air flow information indicates air flow within the fluid path 980.

Figure 14A:
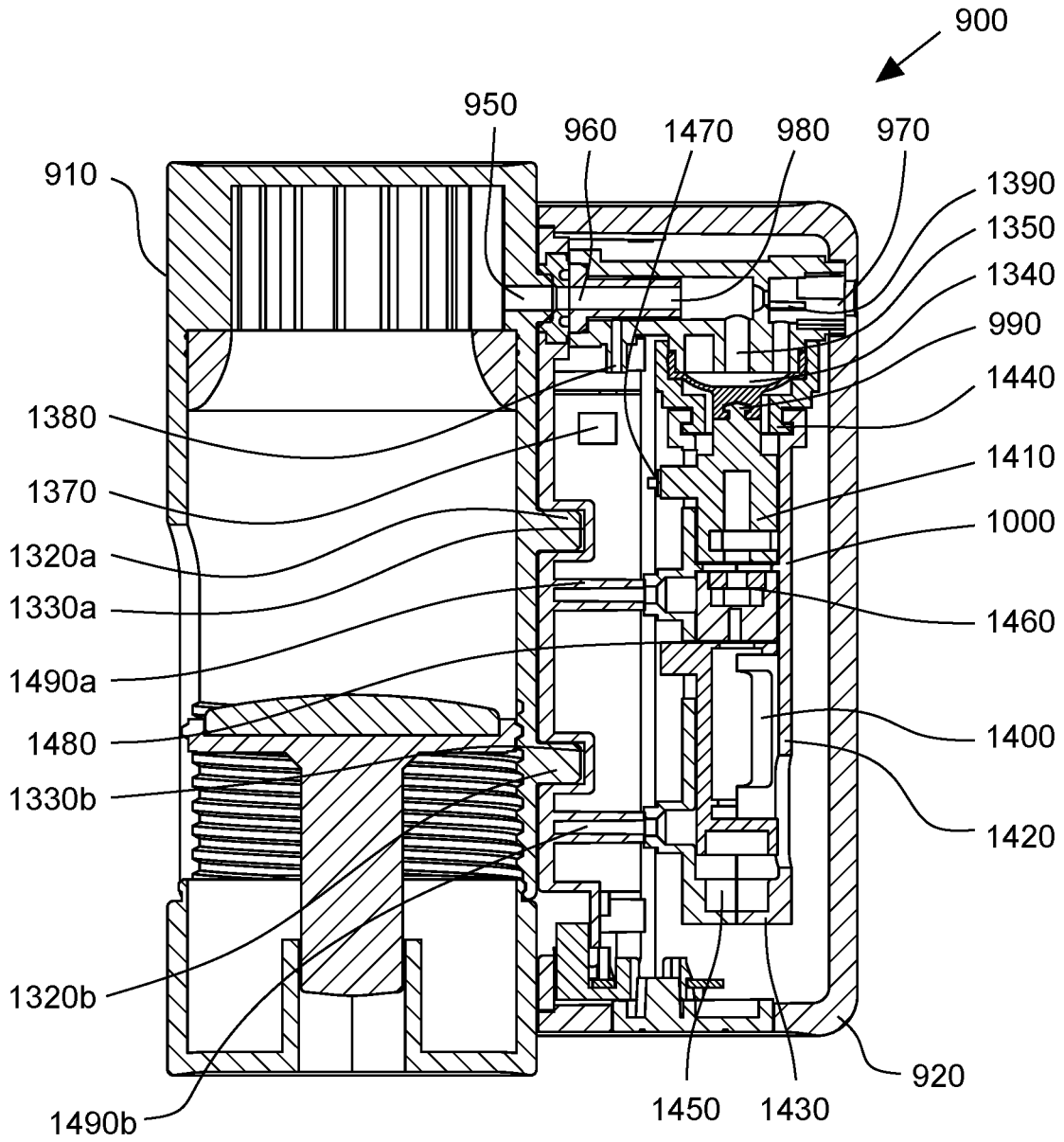
FIG. 14A shows a sectioned view of the of the radiator temperature control apparatus of FIG. 9 in a first configuration.
Figure 14B:
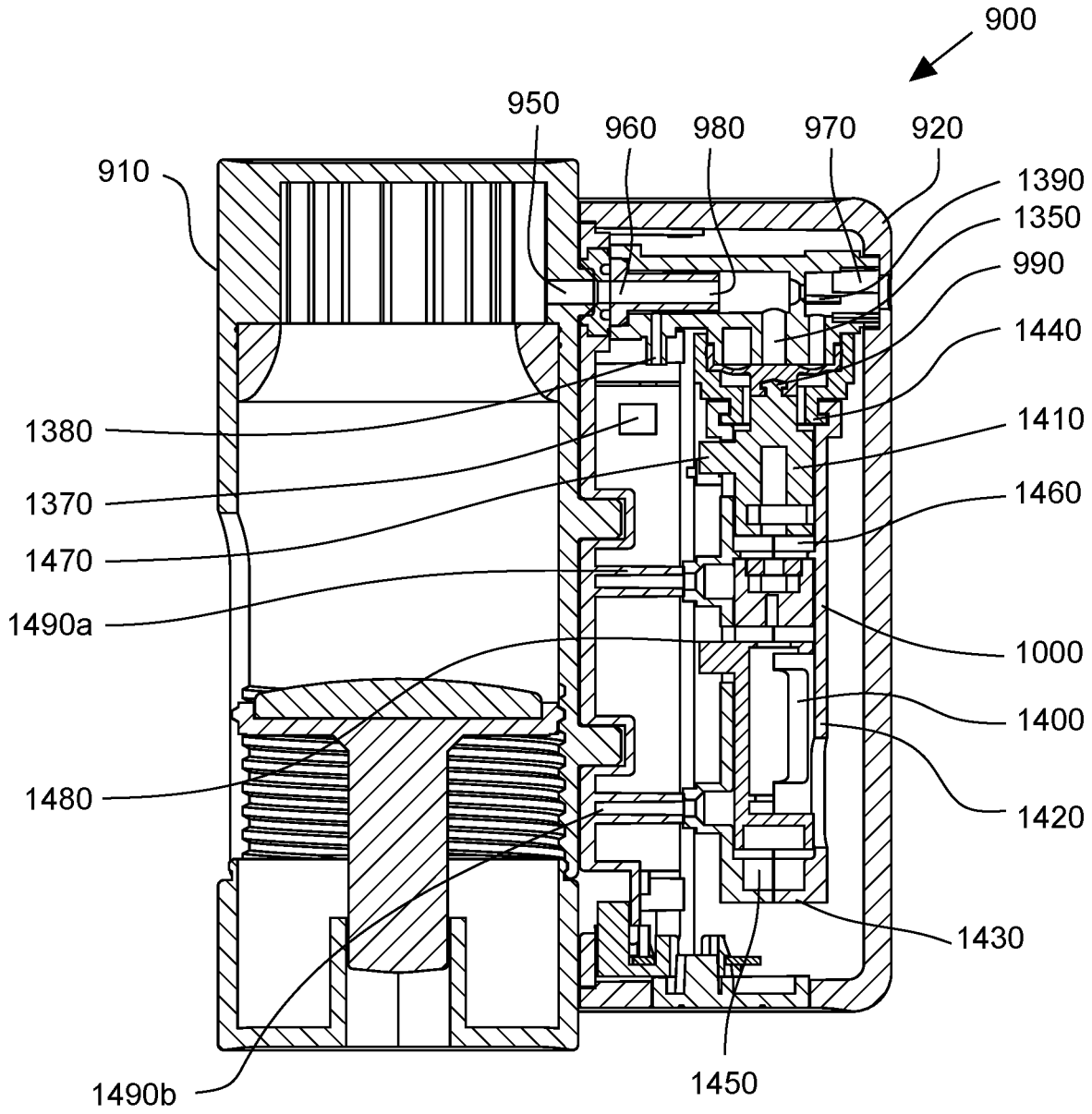
FIG. 14B shows a sectioned view of the of the radiator temperature control apparatus of FIG. 9 in a second configuration.

FIG. 14A shows a sectioned view of the of the radiator temperature control apparatus 900 of FIG. 9 in a first configuration, where the actuator 1000 is in an open position, and wherein the membrane 990 is not applied to the terminal end 1350 of the fluid inlet 960, thereby showing the fluid chamber 1340, and FIG. 14B shows a sectioned view of the of the radiator temperature control apparatus 900 of FIG. 9 in a second configuration in which the actuator 1000 applies force to the membrane 990 thereby closing the blockage.

In the embodiment shown, the actuator 1000, when actuated, applies an actuation pressure to close the blockage 990. The pressure applied by the actuator 1000 is limited to a limiting pressure, and the limiting pressure is greater than the actuation pressure. As such, the actuator 1000 limits the potential pressure that can be applied by the actuator. This keeps the pressure applied within a narrow range above the actuation pressure.

The actuator 1000 typically comprises a bracing element 1400 and an actuation tip 1410. So long as the pressure being applied by the actuator 1000 is below the limiting pressure, the bracing element 1400 remains at a fixed location relative to a housing 1420 of the actuator, and is at a fixed location relative to the second housing 920.

When the actuator 1000 is used to close the blockage 990, the actuation tip 1410 is moved relative to the bracing element 1400 in order to apply the actuation pressure and thereby close the blockage. Typically, the bracing element 1400 is a motor for driving the actuator, and the actuation tip 1410 is any element that can apply force to the blockage 990, such as the membrane discussed above, in order to close the blockage. For example, the actuation tip 1410 may be a shaft or a plunger.

As noted above, the actuator may have an actuator housing 1420 which may have a first end 1430 and an actuation end 1440. The bracing element 1400 may then be adjacent the first end 1430 and the actuation tip 1410 may be adjacent the actuation end 1440, which may be exposed to the blockage 990.

In order to limit the pressure applied by the actuator 1000 to the limiting pressure, the actuator 1000 may further comprise a spring 1450 having a spring force substantially equal to the limiting pressure, and the bracing element 1400 may be fixed relative to the first end 1430 of the actuator housing 1420 by the spring. Because the actuator housing 1420 is fixed relative to the blockage 990, the bracing element 1400 is therefore fixed relative to the blockage by the spring 1450.

The actuation pressure is applied to the blockage 990 by increasing a distance between the bracing element 1400 and the actuation tip 1410. Accordingly, so long as the pressure applied by the actuation tip is below the limiting pressure, the bracing element 1400 remains fixed and the pressure generated by the actuator 1000 is applied to the blockage. However, if the pressure generated by the actuator exceeds the limiting pressure, the bracing element 1400 moves against the spring 1450 and thereby no longer applies additional pressure to the blockage 990.

As shown, the actuation pressure may be applied from the bracing element 1400 to the actuation tip 1410 by using a leadscrew 1460. The bracing element 1400 may then be a motor for rotating the leadscrew 1460.

In order to further control the actuator 1000, limit switches 1470, 1480 may be provided for determining the configuration of the actuator and to determine when the actuator should be deactivated in its fully open or fully closed configurations. In order to open the blockage 990, the leadscrew 1460 pulls the actuation tip 1410 towards the bracing element 1400. The actuation tip 1410 may then impinge a limit switch 1470 to indicate that the actuation tip 1410 is fully retracted.

In order to close the blockage 990, the lead screw 1460 pushes the actuation tip 1410 away from the bracing element 1400. A lead surface of the actuation tip 1410 then makes contact with the blockage 990, such as the membrane and applies an actuation pressure. At that point, pressure will increase until the limiting pressure is achieved, and the bracing element 1400 will begin to move against the spring 1450. The bracing element 1400 will then make contact with its limit switch 1480 to indicate that the actuator 1000 is fully extended, thereby creating a predictable seal.

The actuator 1000 may be controlled by control circuitry (not shown). Accordingly, locator pins 1490*a, b* may be provided to provide registration for switch positions to the circuitry.

FIG. 15A shows a perspective view of the radiator temperature control apparatus 900 of FIG. 9 in use with an alternative example of a first housing 1500 with an outer casing of the second housing 920 removed. FIG. 15B shows a sectioned view of the radiator temperature control apparatus 910 of FIG. 15A.

As shown, a first housing 1500 is provided, and the second housing 920 is mated with the first housing. As discussed above with respect to FIGS. 13A-13C, when the second housing 920 is applied to the first housing 1500, a fluid outlet 1510 of the first housing 1500 is in fluid communication with the fluid inlet 960 of the second housing.

The second housing 920 includes a fixation mechanism 1300 for fixing to a corresponding fixation point 1310 of the first housing 1500. The first housing 1500 further comprises locating pins 1520*a, b* which mate with corresponding cavities 1330*a, b* in the second housing 920. Accordingly, the fixation mechanism 1300 and cavities 1330*a, b* locate the second housing 920 such that the fluid inlet 960 is properly located adjacent the fluid outlet 1510 of the first housing 910.

The interior components of the first housing 1500 are similar to those shown above in FIGS. 12A-12B. As discussed there, the housing at least partially encloses an existing radiator air vent 1210 in a housing with a gasket 1230 provided at the upper end of the housing 1500, such that a venting tower 1240 of the vent is captured within or above the gasket. An internal chamber 1250 is formed about the upper element 1240 such that the fluid outlet of the vent 1210 vents to within the chamber.

The second housing 920 shown in FIGS. 15A-15B is the same as the second housing shown in FIGS. 14A-14B, and the description of the actuator 1000 and other components described therein apply similarly.

Further, the various radiator temperature control apparatuses discussed with respect to FIGS. 9A-15B may be utilized to implement various methods for controlling the radiator temperature, including those methods discussed above with respect to FIGS. 1-8.

Although the foregoing specification has described specific examples and embodiments of the present invention, it will be readily apparent to those of ordinary skill in the art that other embodiments and examples may exist without departing from the broader spirit and scope of the invention. Said other embodiments and examples are contemplated and intended to be covered by the following claims. While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A radiator temperature control apparatus comprising:

a first housing for enclosing at least a portion of a radiator air vent, the first housing comprising;

a sealing mechanism for forming a seal about an air outlet of the radiator air vent;

an internal chamber formed within the first housing and sealed at least partially by the sealing mechanism; and a fluid outlet in a wall of the internal chamber, and a second housing independent of the first housing, the second housing comprising:

a fluid inlet;

a fluid outlet;

a fluid path between the fluid inlet and the fluid outlet;

an adjustable blockage for preventing fluid entering the second housing at the fluid inlet from exiting the second housing at the fluid outlet; and an actuator for opening and closing the blockage;

wherein, when applied to a radiator air vent, the first housing encloses the at least a portion of the radiator air vent, and the second housing is fixed to the first housing such that the fluid outlet of the first housing is in fluid communication with the fluid inlet of the second housing, wherein the sealing mechanism of the first housing is a gasket for sealing against the at least a portion of the radiator air vent and forming the internal chamber, wherein the first housing further comprises a retainer for compressing the at least a portion of the radiator air vent against the gasket, wherein the retainer is a plunger, and wherein the at least a portion of the radiator air vent is sandwiched between the plunger and the gasket.

2. The radiator temperature control apparatus of claim 1, wherein the radiator air vent is a bullet or cylinder shaped vent, and wherein the first housing is substantially cylindrical and has a side opening for accommodating an inlet of the radiator air vent.

3. The radiator temperature control apparatus of claim 1, wherein the blockage is an obstruction of the fluid path closable by the actuator.

4. The radiator temperature control apparatus of claim 3, wherein the second housing further comprises a fluid chamber, and wherein the fluid inlet deposits fluid into the fluid chamber, and wherein the blockage is a membrane for sealing a terminal end of the fluid inlet and the actuator comprises a shaft for applying a force to seal the membrane against the terminal end.

5. The radiator temperature control apparatus of claim 1 further comprising a pressure sensor for detecting pressure within the fluid path.

6. The radiator temperature control apparatus of claim 5, wherein the pressure sensor detects pressure in the fluid path between the fluid inlet and the blockage.

7. The radiator temperature control apparatus of claim 6, wherein the pressure sensor is located outside of the fluid path and detects pressure in the fluid path by way of a pressure probe.

8. The radiator temperature control apparatus of claim 5 further comprising a controller for controlling the actuator, wherein the controller receives pressure information from the pressure sensor and ambient temperature information from a space to be heated by the radiator, and wherein the controller causes the actuator to open the blockage if the ambient temperature is below a set temperature threshold and the pressure information indicates a pressure above a threshold pressure within the fluid path.

9. The radiator temperature control apparatus of claim 1 further comprising a microphone or air flow sensor for detecting air flow in the fluid path.

10. The radiator temperature control apparatus of claim 9, wherein the microphone or air flow sensor detects air flow in the fluid path between the blockage and the fluid outlet.

11. The radiator temperature control apparatus of claim 9 further comprising a controller for controlling the actuator, wherein the controller receives air flow information from the microphone or air flow sensor and ambient temperature information from a space to be heated by the radiator, and wherein the controller causes the actuator to close the blockage if the ambient temperature is above a set temperature threshold and the air flow information indicates air flow within the fluid path.

12. The radiator temperature control apparatus of claim 1, wherein the actuator applies an actuation pressure to close the blockage, and wherein the pressure applied by the actuator is limited to a limiting pressure, the limiting pressure being greater than the actuation pressure.

13. The radiator temperature control apparatus of claim 12, wherein the actuator comprises a bracing element and an actuation tip, and wherein the actuation tip is moved relative to the bracing element to apply the actuation pressure to close the blockage.

14. The radiator temperature control apparatus of claim 13, wherein the actuator further comprises a spring for locating the bracing element and having a spring force substantially equal to the limiting pressure, and wherein the actuation pressure is applied by increasing a distance between the bracing element and the actuation tip, and wherein the bracing element is fixed relative to the blockage by the spring at pressures below the limiting pressure and moves against the spring at pressures above the limiting pressure.

15. The radiator temperature control apparatus of claim 13, wherein the actuation tip is moved relative to the bracing element by way of a leadscrew, and wherein the bracing element comprises a motor for rotating the leadscrew.

16. The radiator temperature control apparatus of claim 12, wherein the actuator further comprises an actuator housing having a first end, an actuation end, and an actuation tip adjacent the actuation end and a bracing element adjacent the first end, wherein the bracing element is spaced apart from the first end by a spring, and wherein actuation pressure is applied by the actuation tip relative to the bracing element.

17. The radiator temperature control apparatus of claim 1, wherein, once applied to a radiator vent, the first housing does not move during use and the actuator of the second housing controls fluid flow through the fluid outlet of the first housing.

18. The radiator temperature control apparatus of claim 1, wherein the second housing further comprises a controller for instructing the actuator to open or close the blockage and a wireless communications interface for communications between the controller and at least one of a remote server, a remote user interface, and one or more temperature sensors, disposed outside of the second housing and configured to record ambient temperature data and transmit such data to the controller.

* * * * *